US007243637B2

(12) United States Patent
Kaneko et al.

(10) Patent No.: US 7,243,637 B2
(45) Date of Patent: Jul. 17, 2007

(54) FUEL INJECTOR

(75) Inventors: Hiroyuki Kaneko, Yokohama (JP); Nirihiko Kiritani, Yokosuka (JP); Ryuta Yamaguchi, Yokohama (JP); Takafumi Fukumoto, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/287,387

(22) Filed: Nov. 28, 2005

(65) Prior Publication Data

US 2006/0118651 A1 Jun. 8, 2006

(30) Foreign Application Priority Data

Dec. 2, 2004 (JP) ..... 2004-349508
Oct. 12, 2005 (JP) ..... 2005-298078

(51) Int. Cl.
*F02M 59/46* (2006.01)
*F02G 5/00* (2006.01)

(52) U.S. Cl. ..... 123/467; 123/549

(58) Field of Classification Search ..... 123/467, 123/549, 543, 545, 546, 547, 550; 239/135, 239/585.1, 585, 75
See application file for complete search history.

(56) References Cited

U.S. PATENT DOCUMENTS 5,400,969 A * 3/1995 Keene ..... 239/136
5,690,080 A * 11/1997 Pelgrim et al. ..... 123/549
5,758,826 A * 6/1998 Nines ..... 239/136
6,779,513 B2 * 8/2004 Pellizzari et al. ..... 123/549
6,814,309 B2 * 11/2004 Rieger et al. ..... 239/533.2
7,059,307 B2 * 6/2006 Pellizzari et al. ..... 123/549
2003/0015594 A1 * 1/2003 Kelly ..... 239/3
2003/0127543 A1 * 7/2003 Rieger et al. ..... 239/584
2004/0003801 A1 * 1/2004 Linna et al. ..... 123/549
2004/0226546 A1 * 11/2004 Pellizzari et al. ..... 123/549

FOREIGN PATENT DOCUMENTS

JP H10-141170 5/1998

* cited by examiner

*Primary Examiner*—Mahmoud Gimie
(74) *Attorney, Agent, or Firm*—Global IP Counselors

(57) ABSTRACT

A fuel injector configured and arranged to inject fuel into a combustion chamber comprises a casing member, a fuel discharge valve and a micro nozzle. The casing member includes a hydraulic chamber configured to contain pressurized fuel and a flow rate regulating hole arranged to discharge the fuel from inside the hydraulic chamber. The fuel discharge valve is configured and arranged to open and close the flow rate regulating hole. The micro nozzle is disposed in a downstream part with respect to the fuel discharge valve, and has at least one through hole arranged to inject the fuel discharged from the flow rate regulating hole into the combustion chamber. The micro nozzle further includes a heating structure configured and arranged to selectively emit heat to raise temperature of the fuel that passes through the at least one through hole of the micro nozzle upon activation of the heating structure.

15 Claims, 18 Drawing Sheets

FUEL INJECTOR

CROSS-REFERENCE TO RELATED APPLICATIONS

This application claims priority to Japanese Patent Application Nos. 2004-349508 and 2005-298078. The entire disclosures of Japanese Patent Application Nos. 2004-349508 and 2005-298078 are hereby incorporated herein by reference.

BACKGROUND OF THE INVENTION

1. Field of the Invention

The present invention generally relates to an injector for injecting a fluid that is at a high temperature and a high pressure. More specifically, the present invention relates a fuel injector for injecting fuel in a high temperature and high pressure state into a combustion chamber of an internal combustion engine.

2. Background Information

Japanese Laid-Open Patent Publication No. 10-141170 discloses a conventional injector used to inject fuel in a high temperature and high pressure liquid state or a supercritical state into a combustion chamber of an internal combustion engine to promote atomization and vaporization of the injected fuel and to improve combustion inside the combustion chamber. The conventional injector presented in the above mentioned reference is provided with an internal heating element configured and arranged to heat the fuel supplied to the fuel injector, and an adjustable valve configured and arranged to control the amount of the heated fuel that is injected. After the fuel is heated by the internal heating element, the adjustable valve is controlled so that a proper quantity of the heated fuel is passed through the adjustable valve to be injected into the combustion chamber.

In view of the above, it will be apparent to those skilled in the art from this disclosure that there exists a need for an improved injector. This invention addresses this need in the art as well as other needs, which will become apparent to those skilled in the art from this disclosure.

SUMMARY OF THE INVENTION

It has been discovered that with the conventional injector as disclosed in the above mentioned reference, the heating element heats an excess amount of fuel in advance instead of heating only the amount of fuel required for each individual fuel injection. Consequently, the sizes of the heating element and other parts are comparatively large and the amount of fuel whose temperature is raised is also large. Thus, it takes time for the fuel to be raised to a high temperature.

Consequently, during the internal combustion engine is being started or immediately after the internal combustion engine is started, it is not possible to inject high temperature fuel into the combustion chamber by using the conventional injector. Thus, the atomization performance and the vaporization performance of the fuel are poor, and the internal combustion engine cannot be controlled to a good combustion state during starting and immediately after starting.

The present invention was conceived in view of this issue regarding achieving good combustion during and immediately after engine starting. One object of the present invention is to provide a fuel injector that can achieve good fuel temperature raising performance.

In order to achieve the above object and other objects of the present invention, a fuel injector configured and arranged to inject fuel into a combustion chamber of an engine is provided that comprises a casing member, a fuel discharge valve and a micro nozzle. The casing member includes a hydraulic chamber configured to contain pressurized fuel at a prescribed pressure and a flow rate regulating hole arranged to discharge the fuel from inside the hydraulic chamber. The fuel discharge valve is configured and arranged to open and close the flow rate regulating hole of the casing member. The micro nozzle is disposed in a downstream part with respect to the fuel discharge valve. The micro nozzle has at least one through hole arranged to inject the fuel discharged from the flow rate regulating hole into the combustion chamber. The micro nozzle further includes a heating structure configured and arranged to selectively emit heat to raise temperature of the fuel that passes through the at least one through hole of the micro nozzle upon activation of the heating structure.

These and other objects, features, aspects and advantages of the present invention will become apparent to those skilled in the art from the following detailed description, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
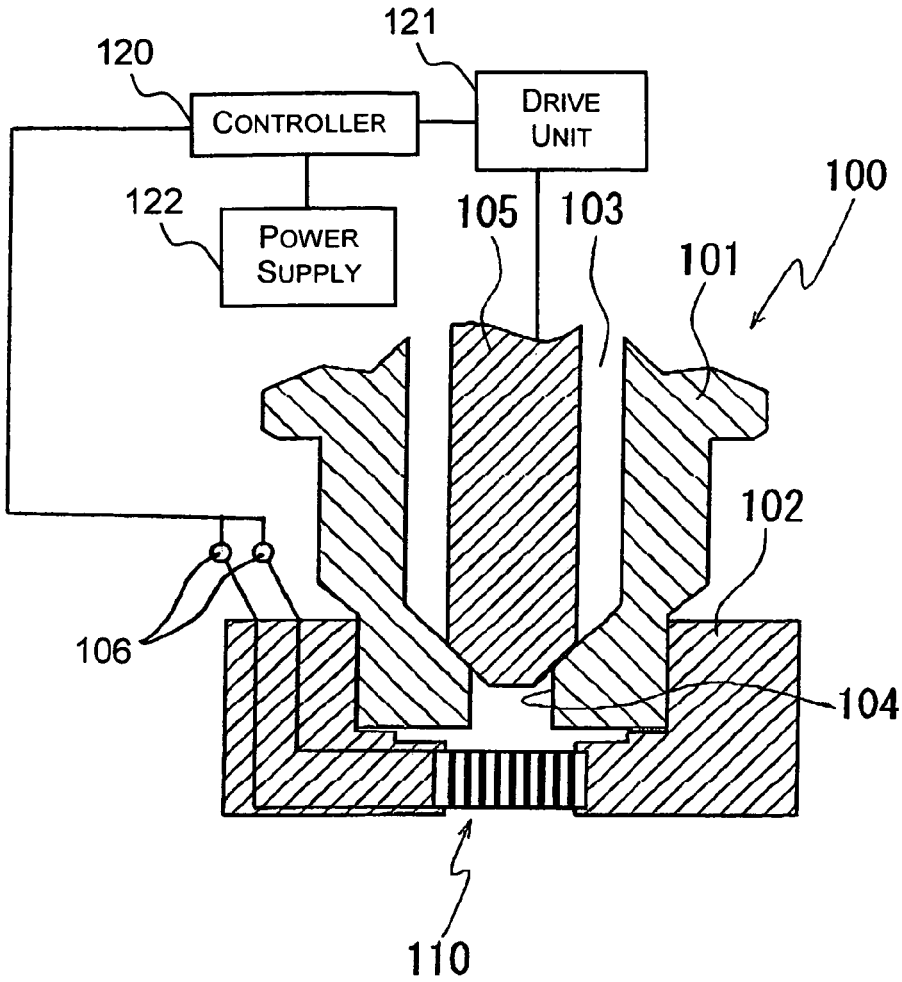
FIG. 1 is a partial cross sectional view of a fuel injector illustrating the vicinity of a fuel injection section of the fuel injector in accordance with a first embodiment of the present invention.

Referring initially to FIG. 1, a fuel injector 100 is illustrated in accordance with a first embodiment of the present invention. FIG. 1 is a partial cross sectional view of the fuel injector 100 in the vicinity of a fuel injection section (i.e., a section where the fuel is injected from) in accordance with the first embodiment.

The fuel injector 100 is configured and arranged to inject fuel that has been pressurized by a fuel pump (not shown) into a combustion chamber of an internal combustion engine. As seen in FIG. 1, the fuel injector 100 basically comprises a casing member 101, a retaining member 102, a needle valve 105, and a micro nozzle 110. Moreover, the fuel injector 100 is preferably operatively coupled to a controller 120 and a drive unit 121. The controller 120 and the drive unit 121 are preferably coupled to a power supply 122.

The casing member 101 is preferably configured and arranged to form an outside cover of the fuel injector 100. The casing member 101 has a hydraulic chamber 103 formed therein for storing the pressurized fuel supplied from the fuel pump. Moreover, the casing member 101 is configured to define a flow rate regulating hole 104 that communicates with the hydraulic chamber 103 in a fuel injection side of the casing member 101 (e.g., the lower side in FIG. 1).

The needle valve 105 is coupled to the casing member 101 as shown in FIG. 1. More specifically, the needle valve 105 is disposed in the hydraulic chamber 103, and configured and arranged such that the needle valve 105 can move in the up and down direction of FIG. 1. The movement of the needle valve 105 is controlled by the controller 120 through the drive unit 121 that is operatively coupled to the needle valve 105. By moving the needle valve 105 up and down, the flow rate regulating hole 104 can be opened and closed with the tip of the needle valve 105. Moreover, by moving the needle valve 105 up and down while adjusting an amount of movement of the needle valve 105, the flow rate of fuel discharged from inside the hydraulic chamber 103 through the flow rate regulating hole 104 can be controlled. The controller 120 is configured to control whether the needle valve 105 is opened or closed, and to control the amount of the movement of the needle valve 105 by controlling the drive unit 121.

The retaining member 102 is mounted to the fuel injection side of the casing member 101 so that the retaining member 102 substantially covers the flow rate regulating hole 104.

The micro nozzle 110 is mounted to the retaining member 102 in a position aligned with and facing toward an opening of the flow rate regulating hole 104 as shown in FIG. 1. The micro nozzle 110 is coupled to a pair of electrodes 106. The electrodes 106 extend from the micro nozzle 110 through the retaining member 102, where they exit to an area outside of the fuel injector 100. The electrodes 106 are operatively coupled to the controller 120 so that the controller 120 is configured to control whether or not electric power is supplied to the electrodes 106 (i.e., timing for supplying electric power to the electrodes 106).

The micro nozzle 110 is configured and arranged such that the fuel that passes through a plurality of through holes 111 formed therein. The micro nozzle 110 is further configured and arranged such that the fuel passing through the through holes 111 is heated as the fuel is injected into the combustion chamber (which is located below the fuel injector 100 in FIG. 1). Accordingly, the flow rate with which the fuel supplied to the hydraulic chamber 103 is discharged from the flow rate regulating hole 104 is controlled by the operation of the needle valve 105, and the fuel discharged from the flow rate regulating hole 104 is heated by the micro nozzle 110 as the fuel is injected into the combustion chamber.

Figure 2:
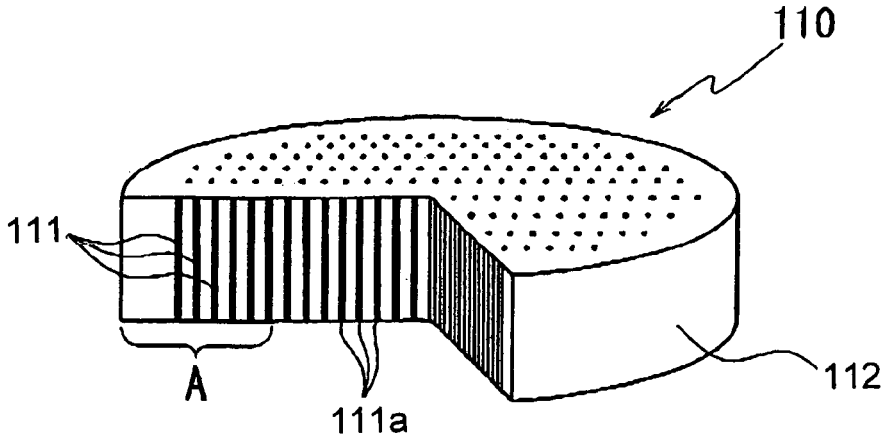
FIG. 2 is a simplified perspective view of a micro nozzle of the fuel injector with the micro nozzle being partially cut away to illustrate an internal structure of the micro nozzle in accordance with the first embodiment of the present invention.
Figure 3:
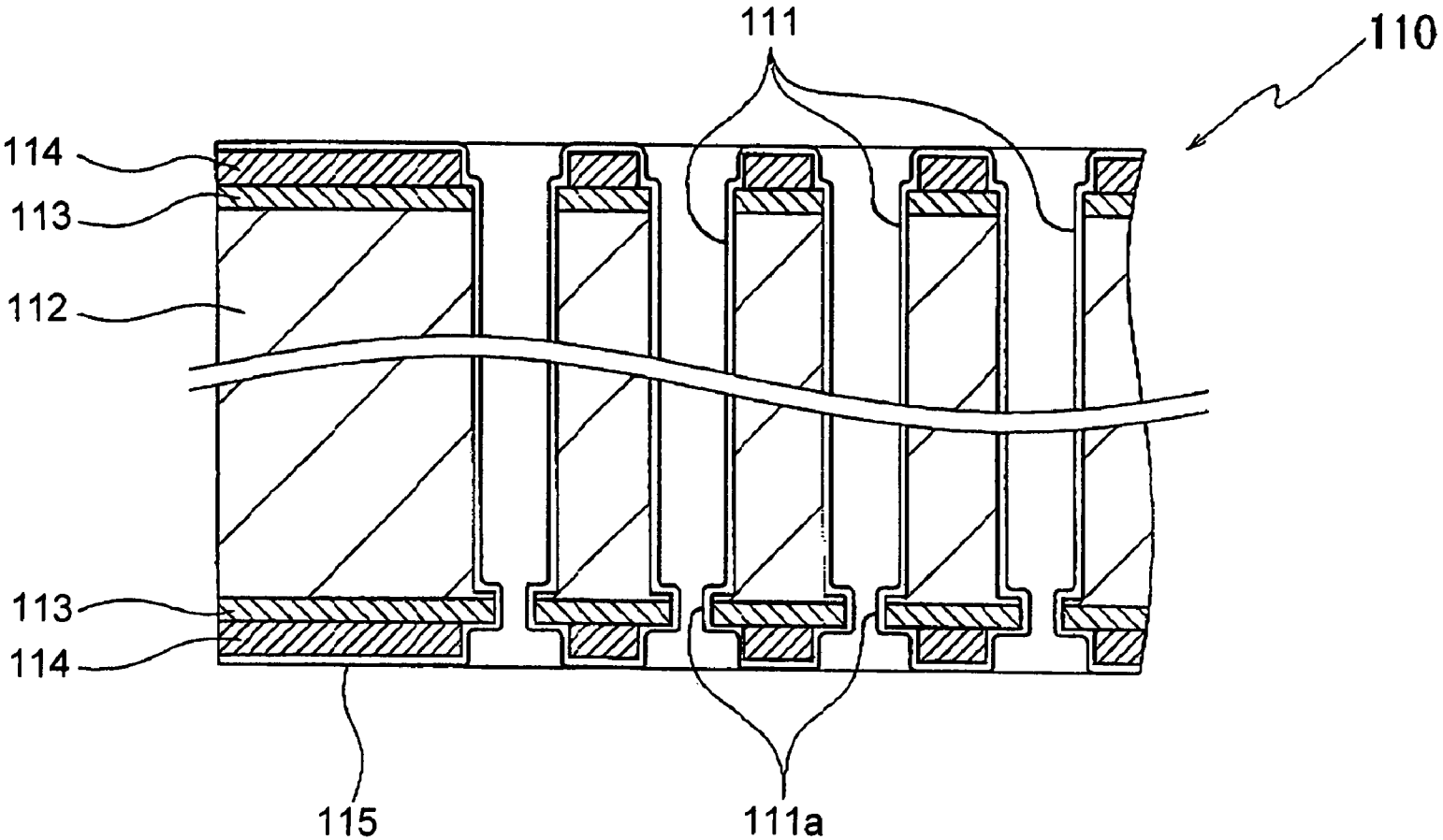
FIG. 3 is an enlarged partial cross sectional view of the micro nozzle illustrating a region A shown in FIG. 2 in accordance with the first embodiment of the present invention.
Figure 4:
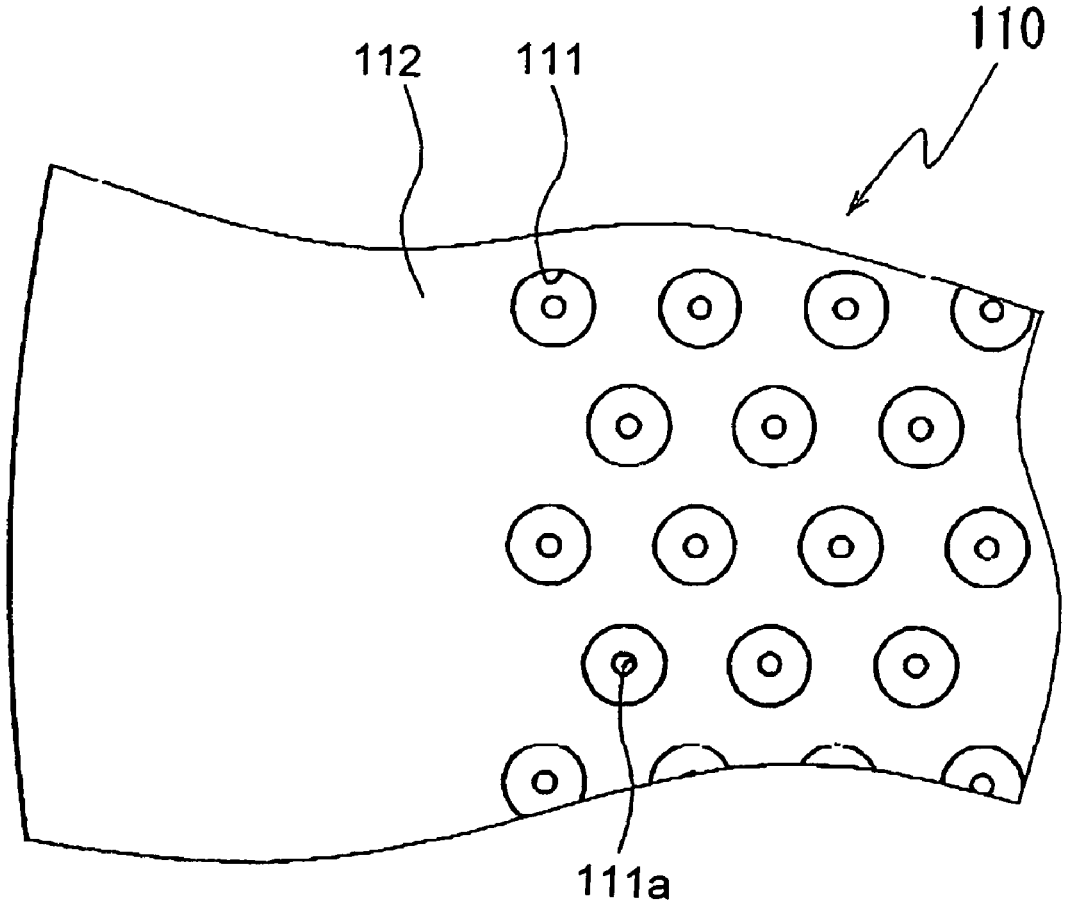
FIG. 4 is a partial top plan view of the micro nozzle in accordance with the first embodiment of the present invention.

Referring now to FIGS. 2 to 4, the micro nozzle 110 will now be described in more detail.

FIG. 2 is an enlarged perspective view of the micro nozzle 110 with a portion of the micro nozzle being cut away to illustrate an internal structure of the micro nozzle 110. As seen in FIG. 2, the micro nozzle 110 has a substantially circular column-shaped, and includes a semiconductor substrate 112 (a heating structure) preferably made of silicon or the like. As mentioned above, the micro nozzle 110 includes the through holes 111 that run through the semiconductor substrate 112 so that the through holes 111 penetrate between two axially facing end surfaces of the semiconductor substrate 112 (hereinafter called the "front and rear surfaces"). The front and rear surfaces of the semiconductor substrate 112 constitute the first and second main surfaces of the present invention. When the micro nozzle 110 is held in the retaining member 102, the through holes 111 communicate between the flow rate regulating hole 104 and the combustion chamber.

FIG. 3 is an enlarged partial cross sectional view of the micro nozzle 110 illustrating a region A shown in FIG. 2. FIG. 4 is an enlarged partial top plan view of the micro nozzle 110 illustrating the arrangement of the through holes 111.

As shown in FIG. 3, two high-concentration impurity layers 113 are provided with one on each of the front and rear surfaces of the semiconductor substrate 112, respectively, in which the through holes 111 are formed. Moreover, a lead electrode 114 is formed on top of each of the high-concentration impurity layers 113 that are on the front and rear surfaces of the semiconductor substrate 112, respectively. The electrodes 106 provided in the retaining member 102 are connected to the lead electrodes 114.

The through holes 111 are formed such that an internal diameter of an opening at a fuel injection end of each of the through holes 111 (i.e., a bottom end of each of the through holes in FIG. 3) is constricted to form a discharge opening 111*a*.

The internal surfaces of the through holes 111 and the front and rear surfaces of the semiconductor substrate 112 (which come in contact with the fuel) are covered with a protective film 115 as shown in FIG. 3. The protective film 115 is configured and arranged to prevent corrosion caused by contact with fuel. The protective film 115 is preferably made of silicon oxide (SiO2) or other material that does not readily react chemically with the fuel.

When a voltage is applied from the power supply 122 through the controller 120 and the electrodes 106 to the lead electrodes 114, electric current flows in the semiconductor substrate 112 in a substantially parallel direction along all of the through holes 111. Thus, the entire semiconductor substrate 112 is configured and arranged to emit heat due to Joule heating (ohmic heating) when the voltage is applied to the lead electrodes 114.

The fuel is pumped from an upper direction to a lower direction in the cross sectional the view shown in FIG. 3. In such case, the flow rate of the fuel can be set appropriately because the discharge openings 111*a* having constricted internal diameters are formed inside the through holes 111. The semiconductor substrate 112 is configured and arranged to raise the temperature of the internal surfaces of the through holes 111, thereby raising the temperature of the fuel that passes through the through holes 111 substantially instantaneously. The controller 120 is configured to control the drive unit 121 and the voltage applied to the electrodes 106 such that the voltage is applied to the electrodes 106 and the semiconductor substrate 112 is heated at a timing substantially corresponding to when the needle valve 105 opens. As a result, high temperature, high pressure fuel can be injected from the discharge openings 111*a* into the combustion chamber. In the illustration shown in FIG. 4, the protective film 115, the lead electrodes 114, and the high-concentration impurity layers 113 are omitted for the sake of brevity.

Referring now to a series of diagrams (a) to (c) of FIG. 5, a method of manufacturing (steps for manufacturing) the micro nozzle 110 will be explained.

Figure 5:
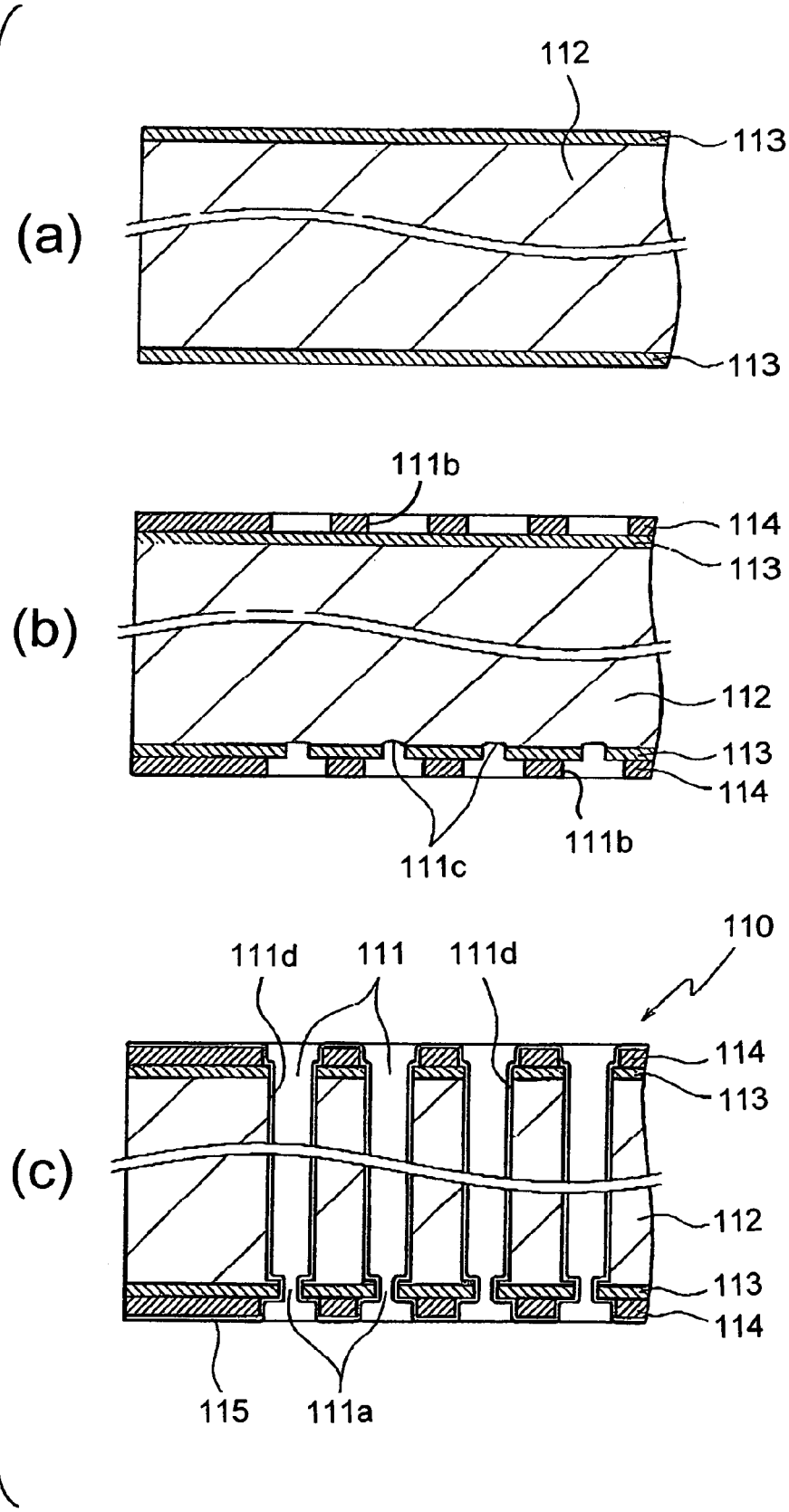
FIG. 5 is a series of diagrams (a) to (c) showing partial cross sectional views of the micro nozzle illustrating steps for manufacturing the micro nozzle in accordance with the first embodiment of the present invention.

As shown in the diagram (a) of FIG. 5, the high-concentration impurity layers 113 are first formed on the front and rear surfaces of the circular column-shaped semiconductor substrate 112 preferably made of silicon or the like. The high-concentration impurity layers 113 are configured and arranged to serve as ohmic contact layers having a low electrical resistance.

Next, as shown in the diagram (b) of FIG. 5, the metal lead electrodes 114 are formed on the high-concentration impurity layers 113 that are on the front and rear surfaces of the semiconductor substrate 112. It is preferable to use a metal that can withstand high temperatures as the lead electrodes 114. For example, aluminum, nickel, chromium, and the like can be used for the lead electrodes 114. Several bores 111*b*, which later form part of the through holes 111, are formed in prescribed positions in the lead electrodes 114 as shown in the diagram (b) of FIG. 5.

Also, as shown in the diagram (b) of FIG. 5, the high-concentration impurity layer 113 formed on the rear surface of the semiconductor substrate 112 is formed with a plurality of recess portions 111*c*, which later become the discharge openings 111*a*, by using a conventional deep RIE or other anisotropic etching method. More specifically, the recessed portions 111*c* are formed by cutting away portions of the semiconductor substrate 112 through the high-concentration impurity layer 113. The recessed portions 111*c* are preferably circular in shape when viewed from below the semiconductor substrate 112, i.e., when the rear surface that is on the bottom from the perspective of FIG. 5 is viewed in a plan view.

Next, as shown in the diagram (c) of FIG. 5, several large diameter holes 111*d* (the main portions of the through holes 111) are formed by performing the deep RIE or other anisotropic etching method from the front surface (e.g., a side from which the fuel enters) toward the recessed portions 111*c*. The large diameter holes 111*d* are formed to have larger internal diameters than the recessed portions 111*c*. The large diameter holes 111*d* and the recessed portions 111*c* constitute the through holes 111 having the discharge openings 111*a*.

Afterwards, the protective layer 115 is formed on the front and rear surfaces of the substrate 112 (on which the high-concentration impurity layers 113 and the lead electrodes 114 have already been formed) and on the internal surfaces of the through holes 111 to complete the micro nozzle 110.

In this embodiment, the needle valve 105 constitutes the fuel discharge valve of the present invention and the semiconductor substrate 112 constitutes the electrically conductive substrate of the present invention.

With the micro nozzle 110 of the first embodiment as described above, the semiconductor substrate 112 is configured and arranged to emit heat when a voltage is applied to the lead electrodes 114 and the resulting heat is readily transferred from the semiconductor substrate 112 to the fuel passing through the through holes 111 provided in the semiconductor substrate 112. As a result, the time required to raise the temperature of the fuel can be shortened.

Also, since the micro nozzle 110 that heats the fuel is arranged downstream of the needle valve 105 of the fuel injector 100 as shown in FIG. 1, only the small amount of fuel that is used in each fuel injection is heated and energy is not wasted by heating fuel that will not be used in an immediate injection. Consequently, the energy efficiency of the fuel heating process is high with the fuel injector 100 of the present invention.

Furthermore, with the fuel injector 100 of the present invention, it is possible to inject high temperature, high pressure fuel that has been heated by the micro nozzle 110 directly into the combustion chamber. Consequently, the high temperature state of the fuel can be maintained and atomization and vaporization of the fuel inside the combustion chamber can be greatly facilitated. As a result, a good combustion state can be achieved.

Additionally, since the fuel is heated by the micro nozzle 110 after the flow rate of the fuel has been adjusted by the needle valve 105, the needle valve 105 and other moving parts are not exposed to the fuel after it is heated and the mechanical reliability of the fuel injector 100 can be improved.

Second Embodiment

Referring now to FIGS. 6 to 10(B), a fuel injector in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

In the second embodiment of the present invention, a micro nozzle 210 is used in the fuel injector 100 shown in FIG. 1 in place of the micro nozzle 110. In other words, a position in which the micro nozzle 210 is mounted to the fuel injector 100 is the same in the second embodiment as the position in which the micro nozzle 110 is mounted to the fuel injector 100 in the first embodiment illustrated in FIG. 1. Thus, a detail description of the structure of the fuel injector 100 is omitted for the sake of brevity.

Figure 6:
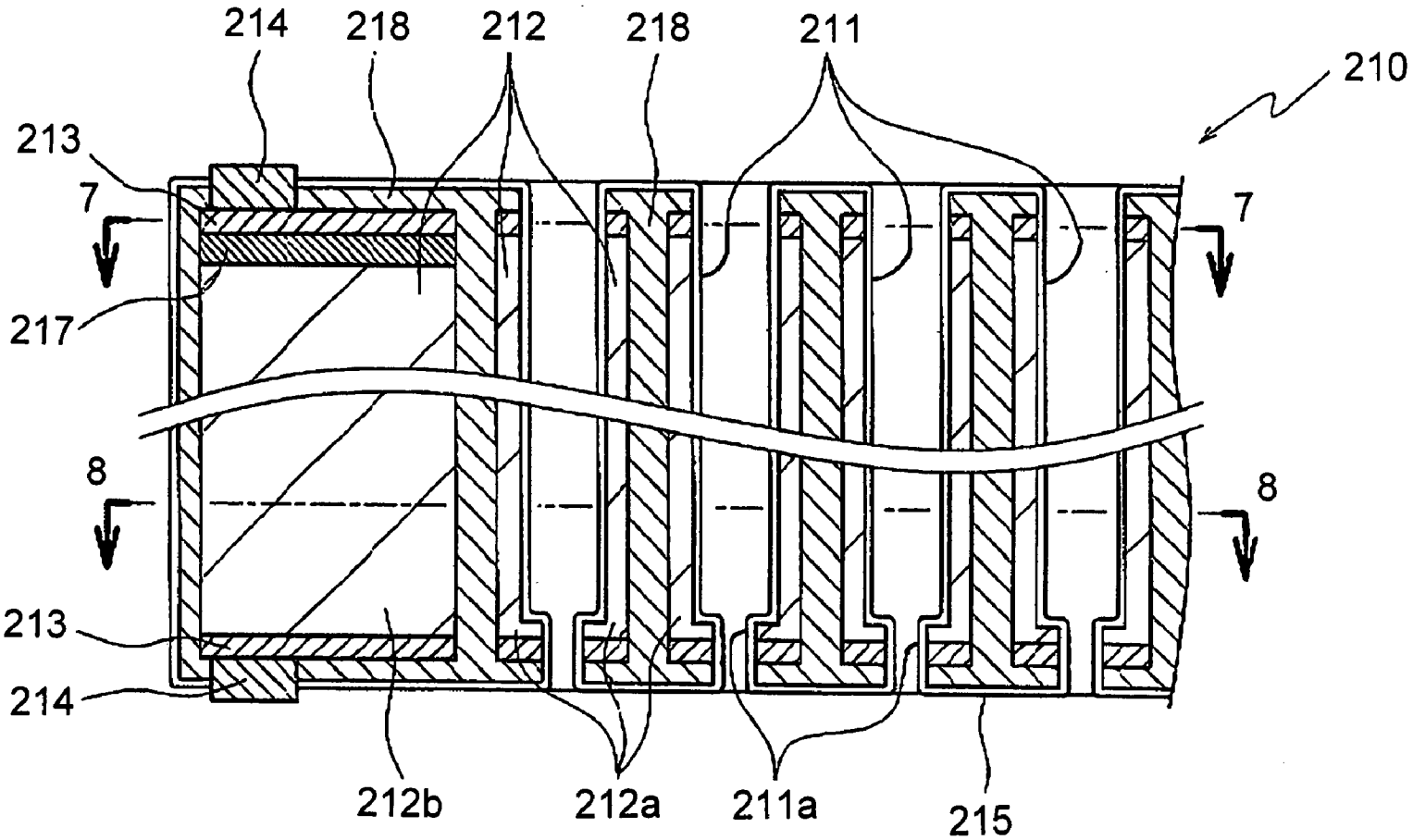
FIG. 6 is a partial cross sectional view of a micro nozzle of a fuel injector taken along a section line 6-6 of FIG. 7 in accordance with a second embodiment of the present invention.
Figure 7:
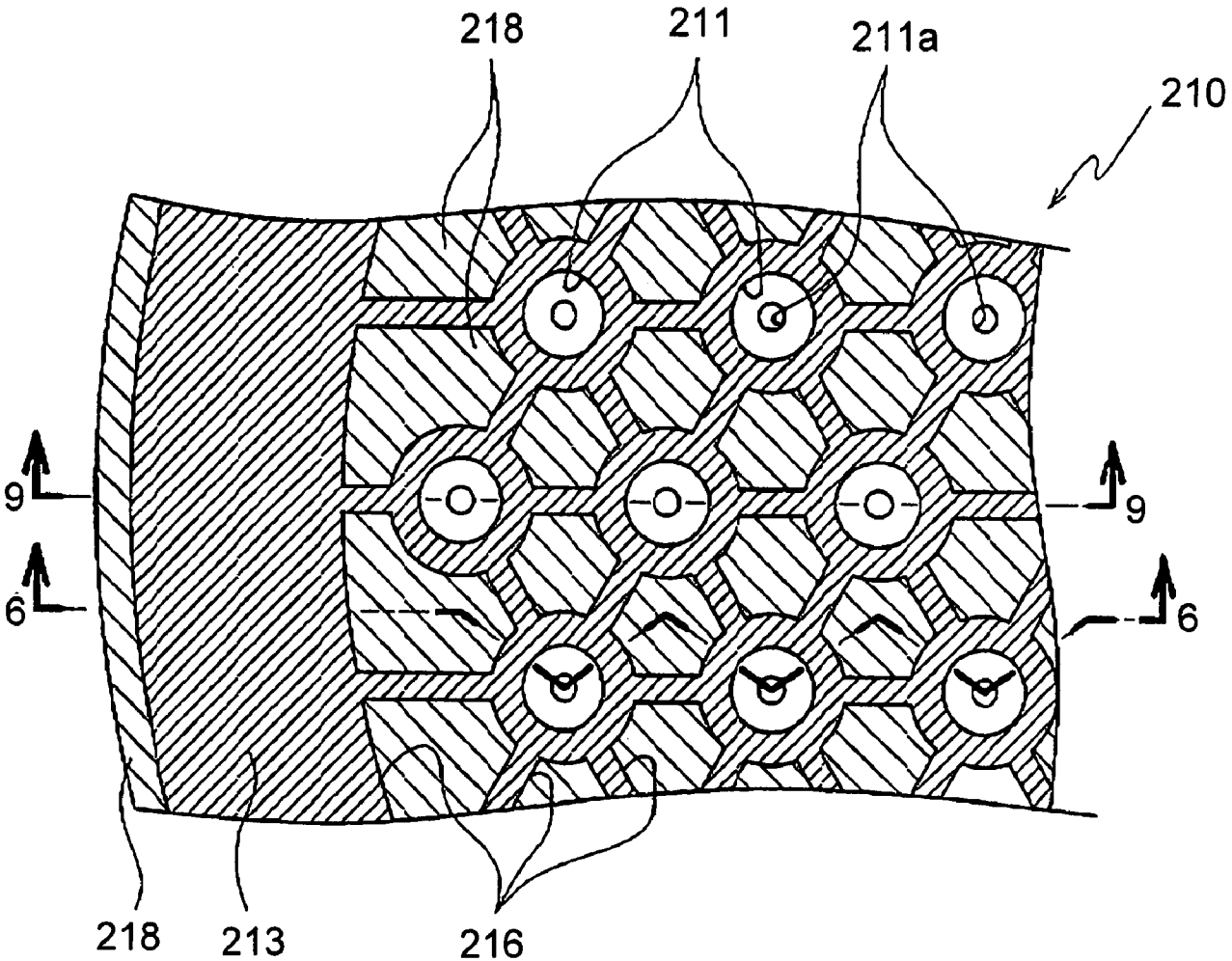
FIG. 7 is a partial cross sectional view of the micro nozzle taken along a section line 7-7 of FIG. 6 in accordance with the second embodiment of the present invention.
Figure 8:
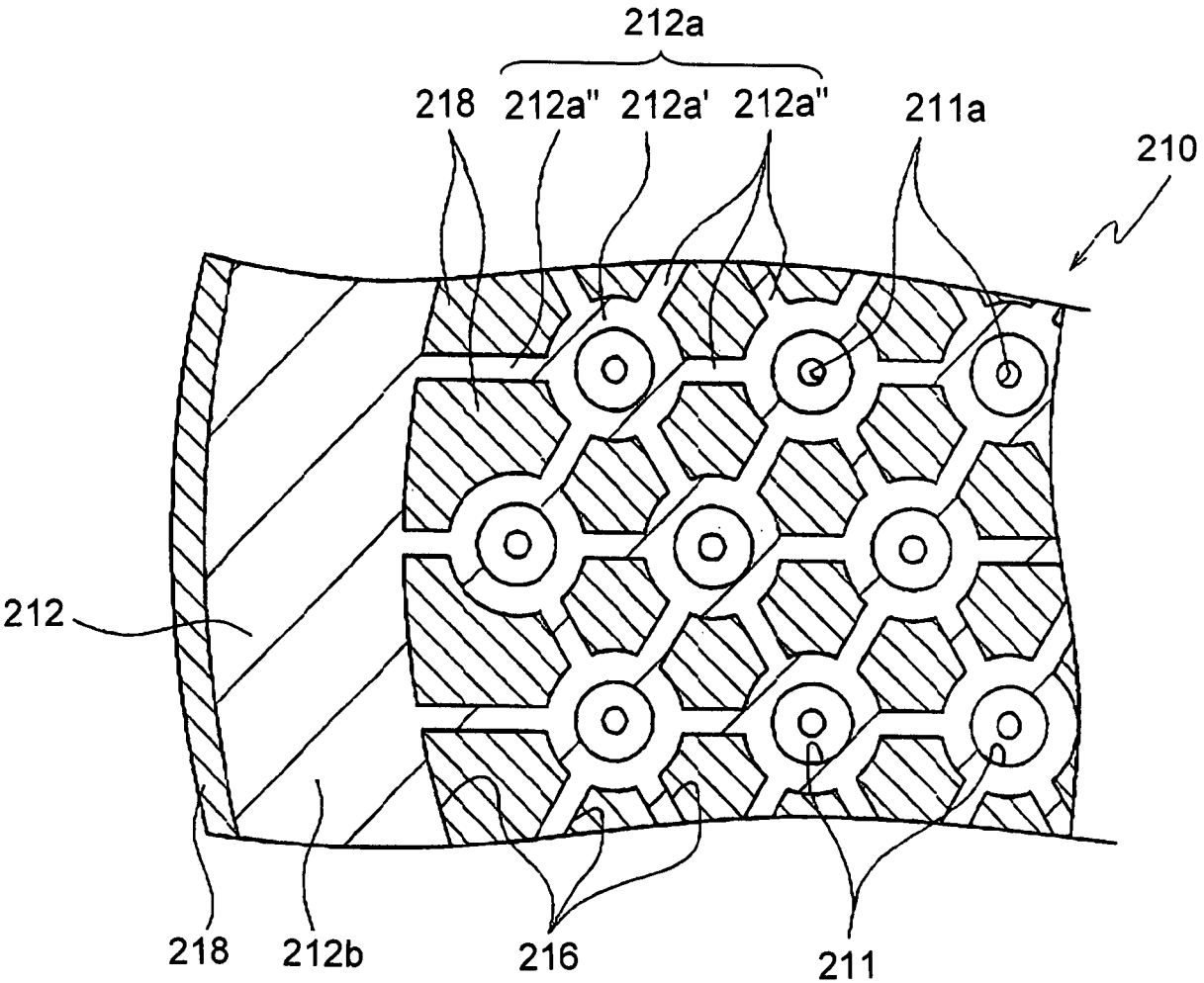
FIG. 8 is a partial cross sectional view of the micro nozzle taken along a section line 8-8 of FIG. 6 in accordance with the second embodiment of the present invention.
Figure 9:
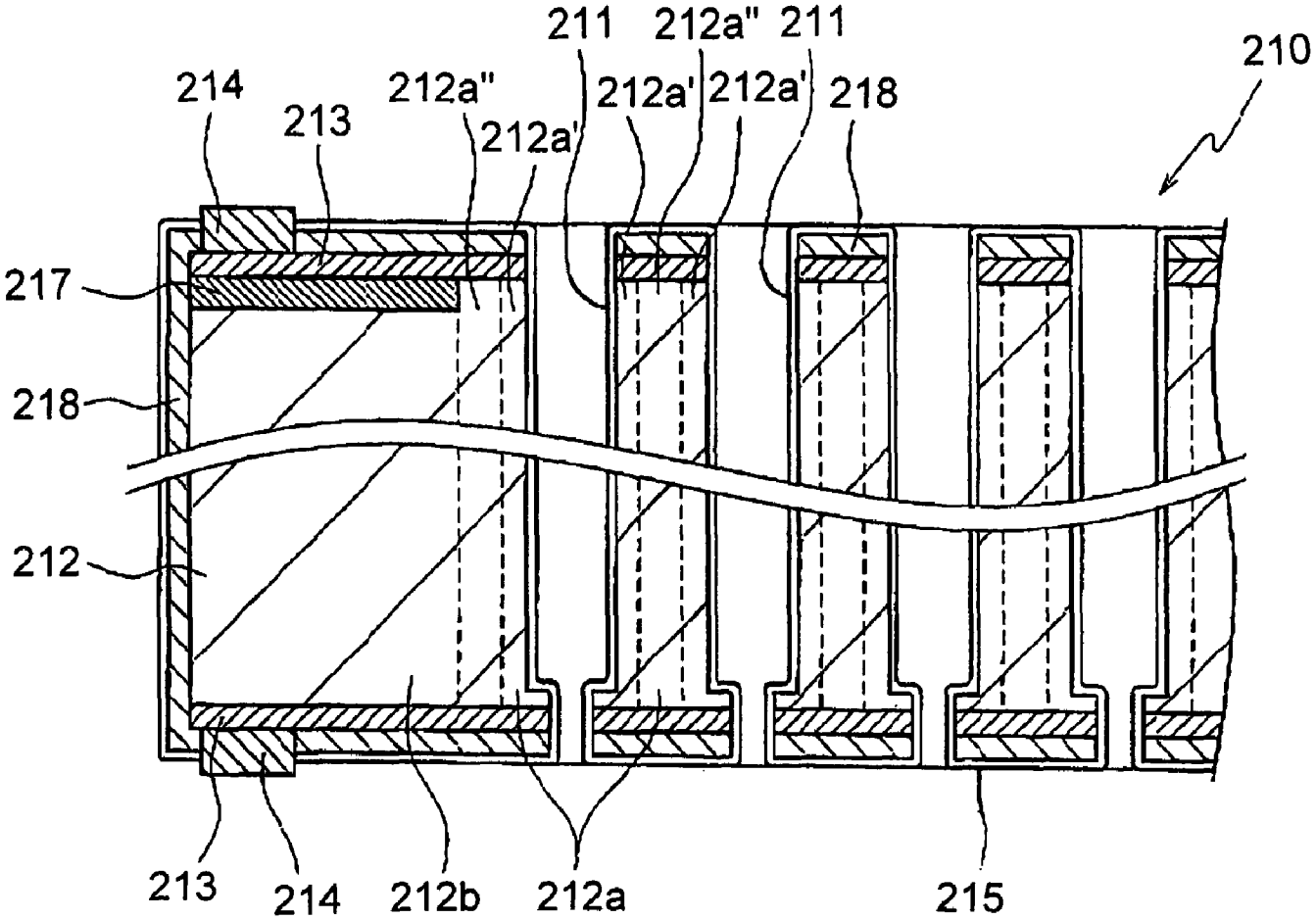
FIG. 9 is a partial cross sectional view of the micro nozzle taken along a section line 9-9 of FIG. 7 in accordance with the second embodiment of the present invention.

FIG. 6 is a partial cross sectional view of the micro nozzle 210 taken along a section line 6-6 in FIG. 7 in accordance with the second embodiment of the present invention. FIG. 7 is a partial cross sectional view of the micro nozzle 210 taken along a section line 7-7 of FIG. 6. FIG. 8 is a partial cross sectional view of the micro nozzle 210 taken along a section line 8-8 of FIG. 6. FIG. 9 is a partial cross sectional view of the micro nozzle 210 taken along a section line 9-9 of FIG. 7 in accordance with the second embodiment of the present invention.

Similarly to the micro nozzle 110 of the first embodiment, the micro nozzle 210 of the second embodiment has a substantially circular column shaped as shown in FIG. 2. The micro nozzle 210 basically comprises a substantially circular column-shaped semiconductor substrate 212 preferably made of silicon (Si) or the like. The semiconductor substrate 212 includes a through hole forming section 212*a* in which a plurality of through holes 211 are formed, and a cylindrically shaped substrate perimeter section 212*b* that is arranged around the outside perimeter of the through hole forming section 212*a*. The internal diameters of openings at the fuel discharge ends of the through holes 211 (i.e., bottom ends in FIG. 6) are constricted to form discharge openings 211*a*.

As shown in FIGS. 8 and 9, the through hole forming section 212*a* comprises a plurality of cylindrical parts 212*a'* (through hole peripheral portions) with each of the cylindrical parts 212*a'* having the through hole 211 therein, and a plurality of connecting parts 212*a"* (connecting portions). The connecting parts 212*a"* connect adjacent ones of the cylindrical parts 212*a'* together. The connecting parts 212*a"* also connect to the substrate perimeter section 212*b* of the semiconductor substrate 212.

As shown in FIG. 8, the through hole forming section 212*a* of the semiconductor substrate 212 is configured and arranged such that a plurality of thermal separation holes 216 are formed in the spaces surrounded by the cylindrical parts 212*a'* and the connecting parts 212*a"* and the spaces surrounded by the cylindrical parts 212*a'*, the connecting parts 212*a"*, and the substrate perimeter part 212*b*.

As shown in FIG. 6, two high-concentration impurity layers 213 are formed on the front and rear surfaces of the semiconductor substrate 212 to serve as ohmic contacts. Moreover, an impurity layer 217 having an opposite conductivity type as the substrate perimeter section 212*b* is formed on one axially-facing end surface (e.g., an upper surface in FIG. 6) of the substrate perimeter section 212*b* as shown in FIG. 6. The high-concentration impurity layers 213 are formed on the front and rear surfaces of the semiconductor substrate 212 after the impurity layer 217 is formed. Thus, as shown in FIG. 6, the high-concentration impurity layers 213 are formed on the front and rear surfaces of the substrate perimeter section 212*b* (on one of which the impurity layer 217 is already formed) and on the front and rear surfaces of the cylindrical parts 212*a'* and the connecting parts 212*a"* of the through hole forming section 212*a*. The high-concentration impurity layers 213 have an opposite conductivity type as the impurity layer 217. For example, the conductivity types of the semiconductor substrate 212, the high-concentration impurity layers 213, and the impurity layer 217 are n-type, n-type, and p-type, respectively.

The micro nozzle 210 further includes a ring-shaped lead electrodes 214 on the high-concentration impurity layer 213 of each of the front and rear surfaces of the semiconductor substrate 212 in the substrate perimeter section 212*b* as shown in FIG. 6. In the second embodiment, the electrodes 106 provided in the retaining member 102 (FIG. 1) are connected to the lead electrodes 214 so that the voltage is applied to the lead electrodes 214 from the power supply 122 (FIG. 1).

An electrically insulating material 218 in the form of an oxide film or the like encloses the semiconductor substrate 212. Moreover, the thermal separation holes 216 are also filled with the electrically insulating material 218. On the other hand, the insides of the cylindrical parts 212*a'*, i.e., the through holes 211, are not filled with the electrically insulating material 218 and the lead electrodes 214 are not covered with the insulating material 218 as shown in FIG. 6.

In general, substances (e.g., oxide films) having a high electrical resistance also have a high thermal resistance and those possess both electric insulation and thermal insulation characteristics. Thus, by arranging the electrically insulating material 218 as described above, the heat generated in the through hole forming section 212*a* does not transfer to the substrate perimeter section 212*b*. Also, when a potential difference is applied across the lead electrodes 214, an electric current does not flow into the substrate perimeter section 212*b* because the high-concentration impurity layers 213 and the impurity layer 217 formed on the substrate perimeter section 212*b* act as a reverse biased diode. On the other hand, since only material of the same conductivity type exists around the perimeters of the through holes 211, electric current flows in a substantially parallel manner in the cylindrical parts 212*a'* of all the through holes 211 and the cylindrical parts 212*a'* emit heat due to Joule heating.

The internal surfaces of the through holes 211 and the front and rear surfaces of the semiconductor substrate 212 (which come in contact with the fuel) except for the lead electrodes 214 are preferably covered with a protective film 215 as shown in FIGS. 6 and 9. The protective film 215 is configured and arranged to prevent corrosion caused by contact with fuel. The protective film 215 is omitted in FIGS. 7 and 8.

The method of manufacturing the micro nozzle 210 will now be explained.

Figure 10A:
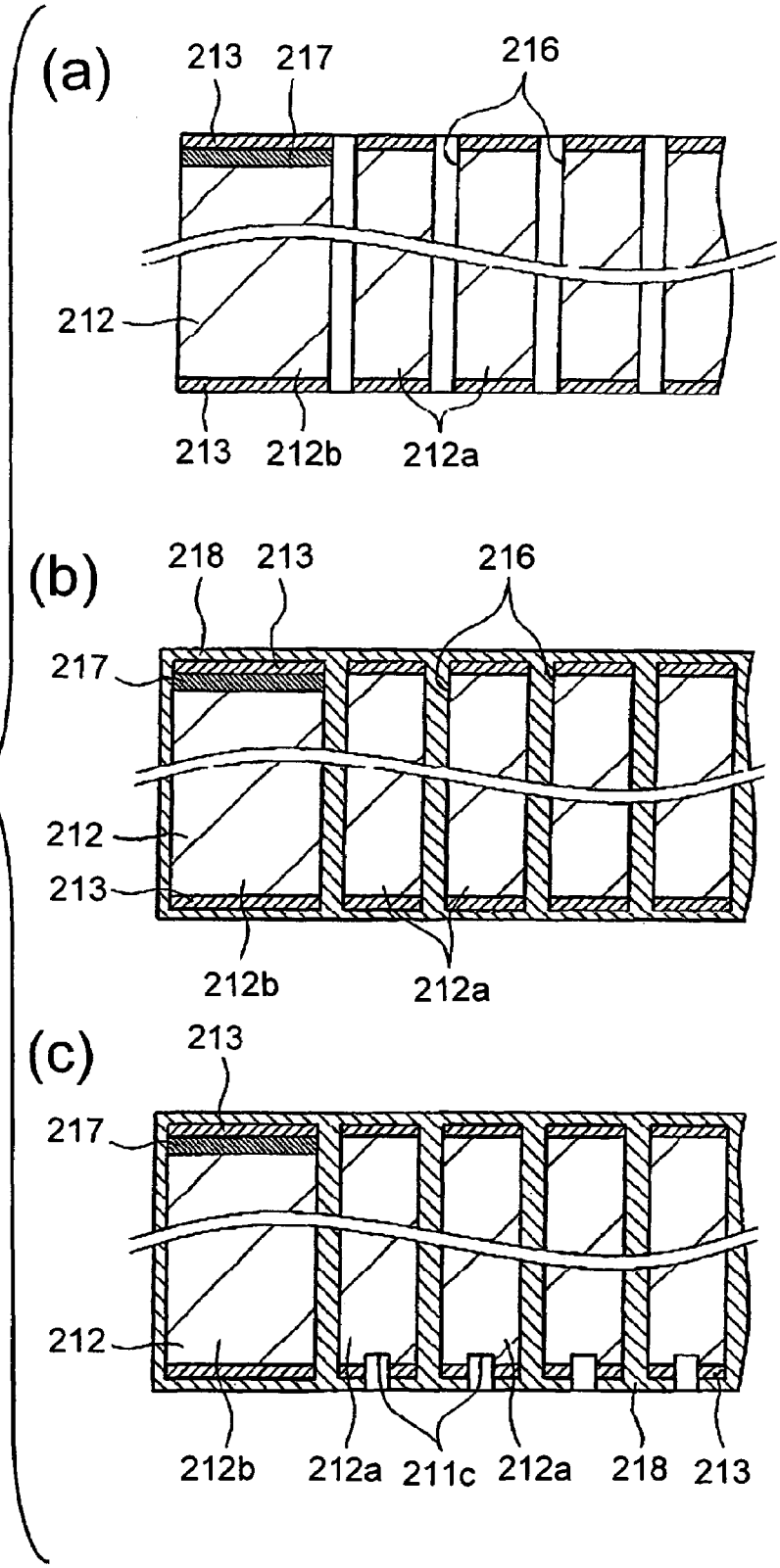
FIG. 10(A) is a series of diagrams (a) to (c) showing partial cross sectional views of the micro nozzle illustrating steps for manufacturing the micro nozzle in accordance with the second embodiment of the present invention.
Figure 10B:
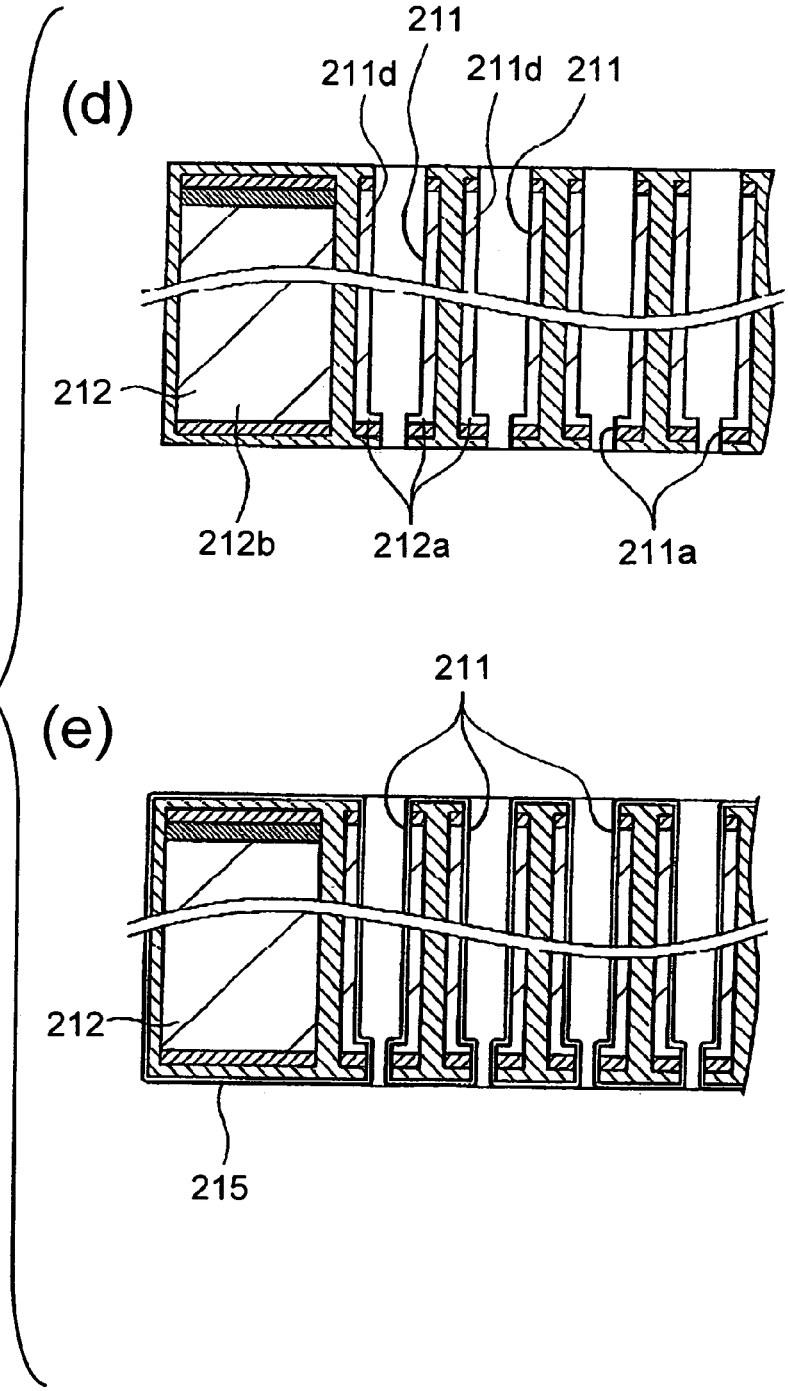
FIG. 10(B) is a pair of diagrams (d) and (e) showing partial cross sectional views of the micro nozzle illustrating steps for manufacturing the micro nozzle following the steps illustrated in the diagrams (a) to (c) of FIG. 10(A) in accordance with the second embodiment of the present invention.

A series of diagrams (a) to (c) of FIG. 10(A) and diagrams (d) and (e) of FIG. 10(B) show partial cross sectional views of the micro nozzle 210 illustrating steps for manufacturing the micro nozzle 210 in accordance with the second embodiment of the present invention.

As shown in the diagram (a) of FIG. 10(A), the impurity layer 217 is formed on the front surface of the outer perimeter portion (i.e., the substrate perimeter section 212*b*) of the circular column-shaped semiconductor substrate 212 made of silicon or the like. Then, the high-concentration impurity layers 213 are formed on the front and rear surfaces of the semiconductor substrate 212, as well as over the impurity layer 217 as shown in the diagram (a) of FIG. 10(A). The high-concentration impurity layers 213 and the impurity layer 217 are formed using conventional ion implantation and thermal diffusion methods. Then, the thermal separation holes 216 that will later serve as thermal insulation regions are formed in the through hole forming section 212*a* (which is located within the inside diameter of the substrate perimeter section 212*b*).

Next, as shown in the diagram (b) of FIG. 10(A), the electrically insulating material 218 is applied to cover the entire semiconductor substrate 212. The electrically insulating material 218 is preferably applied by conventional thermal oxidation or chemical vapor deposition (CVD) to the outside of the semiconductor substrate 212 while also filling the insides of the thermal separation holes 216.

Next, as shown in the diagram (c) of FIG. 10(A), several recessed portions 211*c* are formed in the rear surface (i.e., the bottom surface in the diagram (c) of FIG. 10(A)) of the through hole forming section 212*a* of the semiconductor substrate 212 to pass through the electrically insulating material 218 and the high-concentration impurity layer 213. The recessed portions 211*c* will later become the discharge openings 211*a* that serve to discharge the fuel. A conventional deep RIE or another anisotropic etching method is preferably used to form the recessed portions 211*c*. The recessed portions 111*c* are preferably circular in shape when viewed from below the semiconductor substrate 212, i.e., when the surface that is on the bottom from the perspective of the diagram (c) of FIG. 10(A) is viewed in a plan view.

Next, as shown in the diagram (e) of FIG. 10(B), several large diameter holes 211*d* are formed from the top side of the through hole forming section 212*a* (top side from the perspective of the diagram (e) of FIG. 10(B), i.e., the side from which fuel enters). The large diameter holes 211*d* are preferably formed by using the deep RIE or another anisotropic etching method. The large diameter holes 211*d* are formed to have larger internal diameters than the recessed portions 211*c* as shown in the diagram (d) of FIG. 10(B). The large diameter holes 211*d* and the recessed portions 211*c* constitute the through holes 211 having the discharge openings 211*a*.

Next, as shown in the diagram (e) of FIG. 10(B), the protective film 215 comprising the oxide film is formed on the front and rear surfaces of the substrate 212 and on the internal surfaces of the through holes 211 by thermal oxidation or chemical vapor deposition.

Then, the ring-shaped lead electrodes 214 are formed on the front and rear surfaces of the outer perimeter portion of the substrate perimeter section 212*b* as shown in FIG. 6. More specifically, one surface of each of the lead electrode 214 contacts the high-concentration impurity layer 213 and the other surface is exposed to the outside without being covered by the protective film 215.

In the second embodiment of the present invention, the semiconductor substrate 212 constitutes the electrically conductive substrate of the present invention and the electrically insulating material 218 constitutes the thermal insulation member of the present invention. Additionally, the impurity layer 217 constitutes the first impurity layer of the present invention, the high-concentration impurity layers 213 constitute the second impurity layer of the present invention, and the cylindrical parts 212*a'* constitute the portion where the through hole is formed of the present invention.

The micro nozzle 210 of the second embodiment being configured as described heretofore, heat is not generated in the substrate perimeter section 212*b* because the high-concentration impurity layers 213 and the impurity layer 217 formed on the front and rear surfaces of the outer perimeter portion (i.e., the substrate perimeter section 212*b*) of the semiconductor substrate 212 are connected in a reverse biased fashion. Thus, the micro nozzle 210 is configured and arranged such that only the radially inwardly positioned through hole forming section 212*a* of the micro nozzle 210 emits heat. Also, since the through hole forming section 212*a* and the substrate perimeter section 212*b* are thermally insulated from each other by the electrically insulating material 218, the temperature of the substrate perimeter section 212*b* can be prevented from rising when the through hole forming section 212*a* heats up.

Consequently, the region surrounding the lead electrodes 214 that are provided in the substrate perimeter section 212*b* as external electrode connection leads does not reach high temperatures and highly reliable electrical and mechanical connections can be accomplished.

Since the entire surface (all surfaces) of the micro nozzle 210 excluding the lead electrodes 214 is covered with the protective film 215, corrosion resulting from contact with high temperature, high pressure fuel can be prevented.

Third Embodiment

Figure 11:
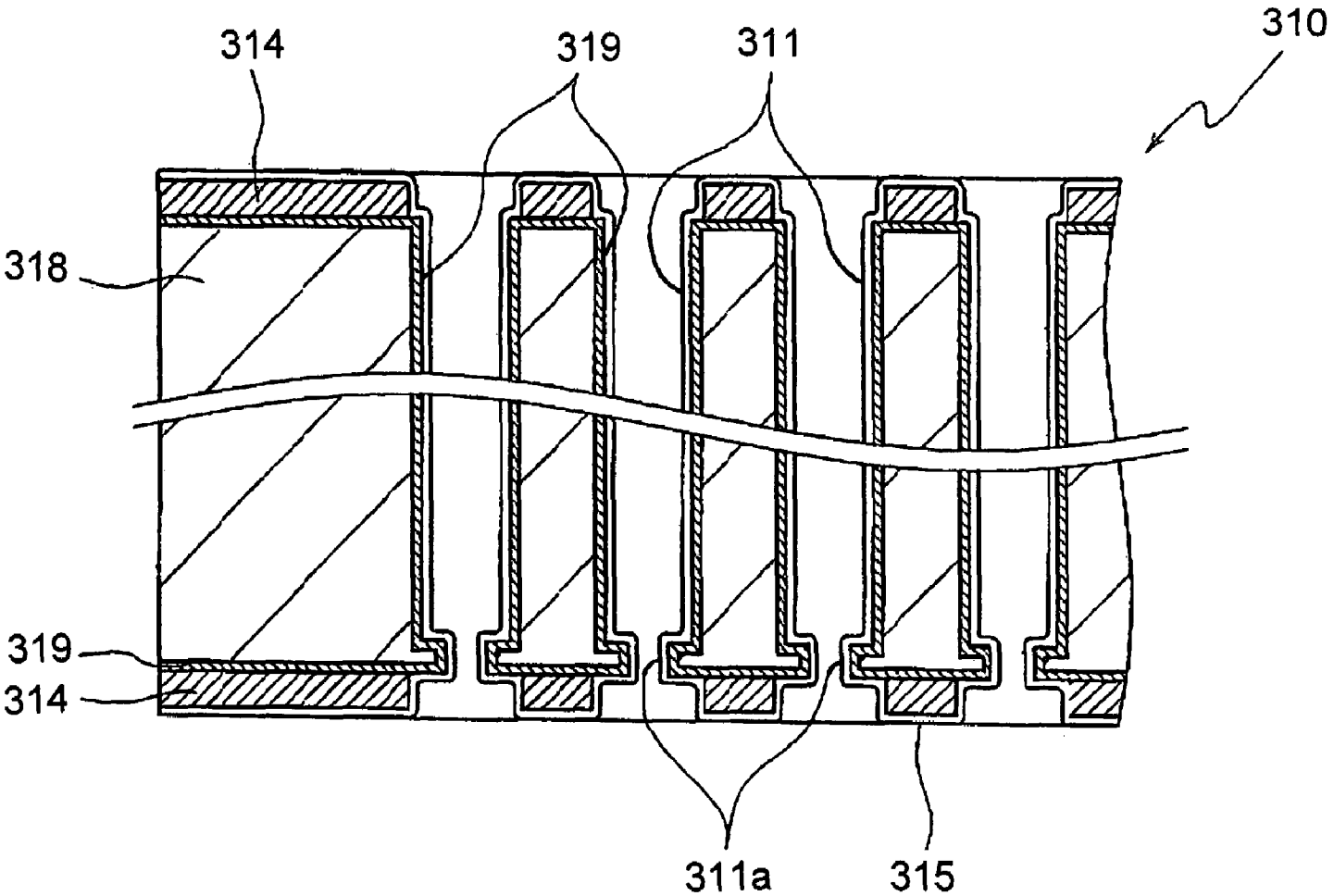
FIG. 11 is a partial cross sectional view of a micro nozzle of a fuel injector in accordance with a third embodiment of the present invention.

Referring now to FIG. 11, a fuel injector in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

In the third embodiment of the present invention, a micro nozzle 310 is used in the fuel injector 100 shown in FIG. 1 in place of the micro nozzle 110. In other words, a position in which the micro nozzle 310 is mounted to the fuel injector 100 is the same as the position in which the micro nozzle 110 is mounted to the fuel injector 100 in the first embodiment illustrated in FIG. 1. Thus, a detail description of the structure of the fuel injector 100 is omitted for the sake of brevity.

The micro nozzle 310 in accordance with the third embodiment differs from the micro nozzle 110 of the first embodiment in that the micro nozzle 310 basically includes an electrically insulating substrate 318 and an electrically conductive thin film 319 instead of the semiconductor substrate 112 and the high-concentration impurity layers 113 of the micro nozzle 110 of the first embodiment.

Figure 12:
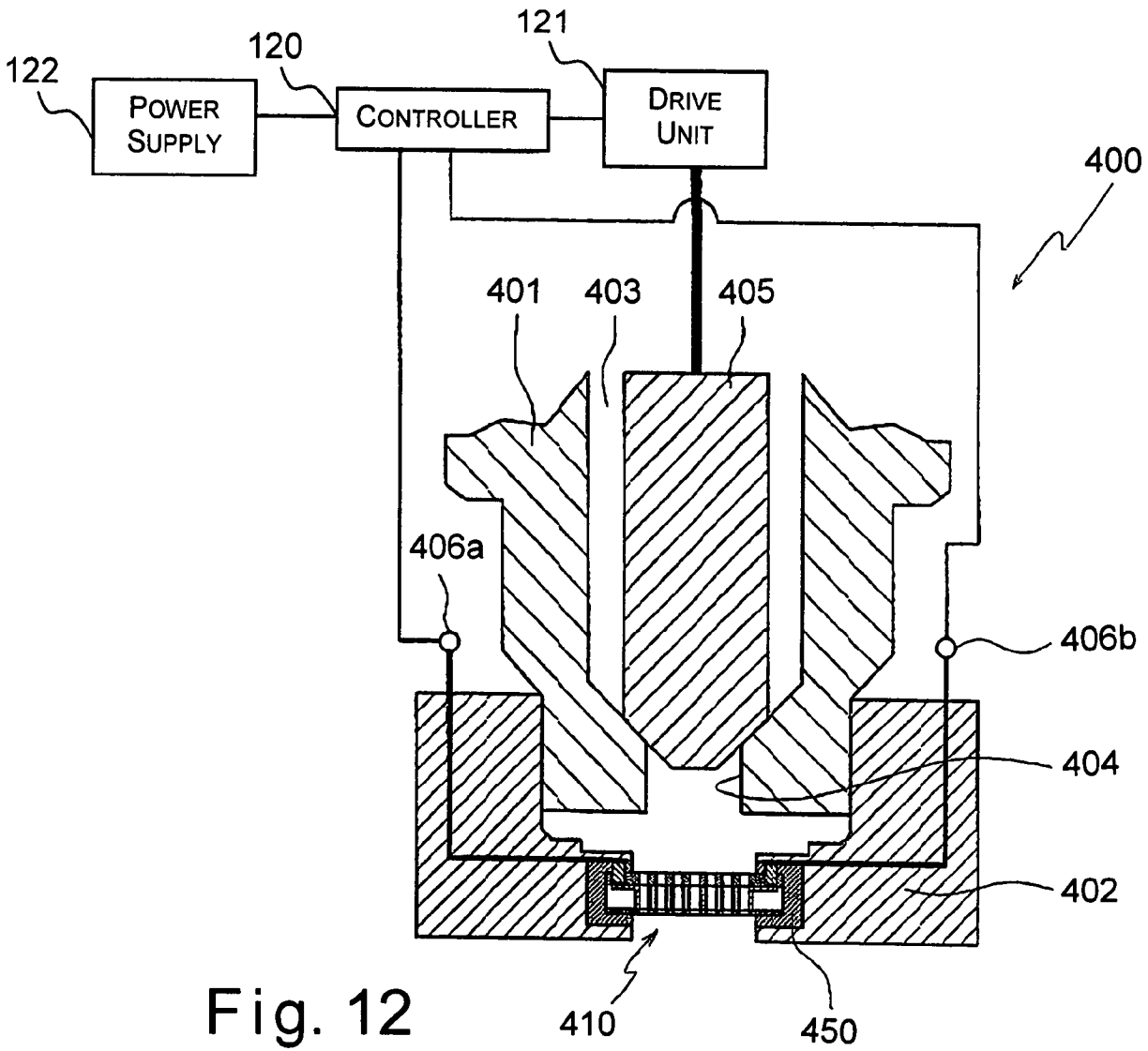
FIG. 12 is a partial cross sectional view of a fuel injector illustrating the vicinity of a fuel injection section of the fuel injector in accordance with a fourth embodiment of the present invention.

FIG. 12 is a partial cross sectional view of the micro nozzle 310 in accordance with the third embodiment. The micro nozzle 310 has the electrically insulating substrate 318 in which a plurality of through holes 311 passing through the front and rear surfaces thereof are formed. The through holes 311 are formed such that an internal diameter of an opening at a fuel injection end of each of the through holes 311 (i.e., a bottom end of each of the through holes in FIG. 11) is constricted to form a discharge opening 311*a*.

As shown in FIG. 11, the front and rear surfaces of the electrically insulating substrate 318 and the internal surfaces of the through holes 311 are covered with the electrically conductive thin film 319. The electrically conductive thin film 319 is preferably formed using an electroless coating method. If it is difficult to obtain a suitable thickness and characteristics with an electroless coating, an electrolytic coating is preferably applied after the electroless coating is formed.

The micro nozzle 310 includes a pair of lead electrodes 314 formed on top of the electrically conductive thin film 319 on both the front surface and rear surface of the electrically insulating substrate 318 as shown in FIG. 11. In the third embodiment, the electrodes 106 provided in the retaining member 102 (FIG. 1) are connected to the lead electrodes 314 so that the voltage is applied to the lead electrodes 314 from the power supply 122 (FIG. 1). When a voltage is applied to the lead electrodes 314, electric current flows evenly to the electrically conductive films 319 formed on the internal surfaces of the through holes 311 and heat is emitted in a uniform manner.

The internal surfaces of the through holes 311 (through which fuel flows) and the front and rear surfaces of the electrically insulating substrate 318 are covered with a protective film 315 that serves to prevent corrosion caused by contact with fuel.

The method of manufacturing the micro nozzle 310 is a modification of the manufacturing methods of the micro nozzles 110 and 210 presented in the first and second embodiments and can be easily surmised based on the descriptions of those manufacturing methods explained above with reference to FIGS. 5, 10(A) and 10(B). Therefore, a description of the manufacturing method of the micro nozzle 310 of the third embodiment is omitted for the sake of brevity.

In the third embodiment of the present invention, the electrically insulating substrate 318 constitutes the insulating substrate of the present invention.

The micro nozzle 310 of the third embodiment being configured as described heretofore, an electric current flows in the electrically conductive thin films 319 formed on the internal surfaces of the through holes 311 when a potential difference is applied to the lead electrodes 314 formed on the front and rear surfaces of the electrically insulating substrate 318. The electric current causes the through holes 311 to heat up due to Joule heating and thereby raise the temperature of fuel passing through the through holes 311. Since a portion of the inside diameter of each of the through holes 311 is constricted so as to form an discharge opening 311 a at the fuel discharge end of the through hole 311, the fuel can be brought to the desired high temperature, high pressure state in the vicinity of the exits of the through holes 311 and supercritical fuel can be injected directly into the combustion chamber.

Since the thermal resistance of the electrically insulating substrate 318 itself is high, the heat emitted from the electrically conductive thin film 319 is transferred in an effective manner to the fuel. Thus, there is little energy loss and the time required to raise the temperature of the fuel can be shortened.

Also, since the thermal resistance of the electrically insulating substrate 318 itself is high, the heat emitted from the electrically conductive thin film 319 does not transfer to the perimeter of the micro nozzle 310. Thus, the portions of the micro nozzle 310 that contact the retaining member 102 (FIG. 1) when the micro nozzle 310 is mounted to the tip of the fuel injector 100 do not reach high temperatures. Consequently, the portions of the retaining member 102 that contact the micro nozzle 310 do not need to be resistant to high temperatures and the reliability of the fuel injector can be improved.

Fourth Embodiment

Referring now to FIGS. 12 to 16, a fuel injector in accordance with a fourth embodiment will now be explained. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

FIG. 12 is a partial cross sectional view of a fuel injection section of a fuel injector 400 in accordance with the fourth embodiment of the present invention. The fuel injector 400 is configured and arranged to inject fuel into a combustion chamber of an internal combustion engine and fuel that has been pressurized by a fuel pump (not shown) is supplied to the fuel injector 400.

The fuel injector 400 comprises a casing member 401, which has substantially the same structure as the casing member 101 of the first embodiment shown in FIG. 1. In other words, the casing member 401 is configured and arranged to form a hydraulic chamber 403 therein and a flow rate regulating hole 404 at a bottom end thereof. A retaining member 402 is mounted to the fuel injection end of the casing member 401 and is configured and arranged to substantially cover the flow rate regulating hole 404. A needle valve 405 is coupled to the casing member 401 such that the control unit 120 is configured to selectively close and open the flow rate regulating hole 404 through the drive unit 121, which is operatively coupled to the needle valve 405.

A micro nozzle 410 is mounted to the retaining member 402 in a position aligned with and facing toward the opening of the flow rate regulating hole 404. Moreover, a thermal separation structural body 450 is disposed between the micro nozzle 410 and the retaining member 402 as shown in FIG. 12. The thermal separation structural body 450 is made of a material having a small heat transfer coefficient, e.g., a ceramic or quartz material.

Two electrodes 406*a* and 406*b* that extend from the micro nozzle 410 are drawn to the outside of the fuel injector 400 through the retaining member 402 as shown in FIG. 12.

The micro nozzle 410 is configured and arranged such that fuel that passes through a plurality of fuel flow passages provided therein is heated as the fuel is injected into the combustion chamber (which is located below the fuel injector 400 when the engine is viewed from the orientation depicted in FIG. 12).

The other constituent features of the fuel injector 400 are substantially the same as the fuel injector 100 in the first embodiment and descriptions thereof are omitted for the sake of brevity.

Figure 13:
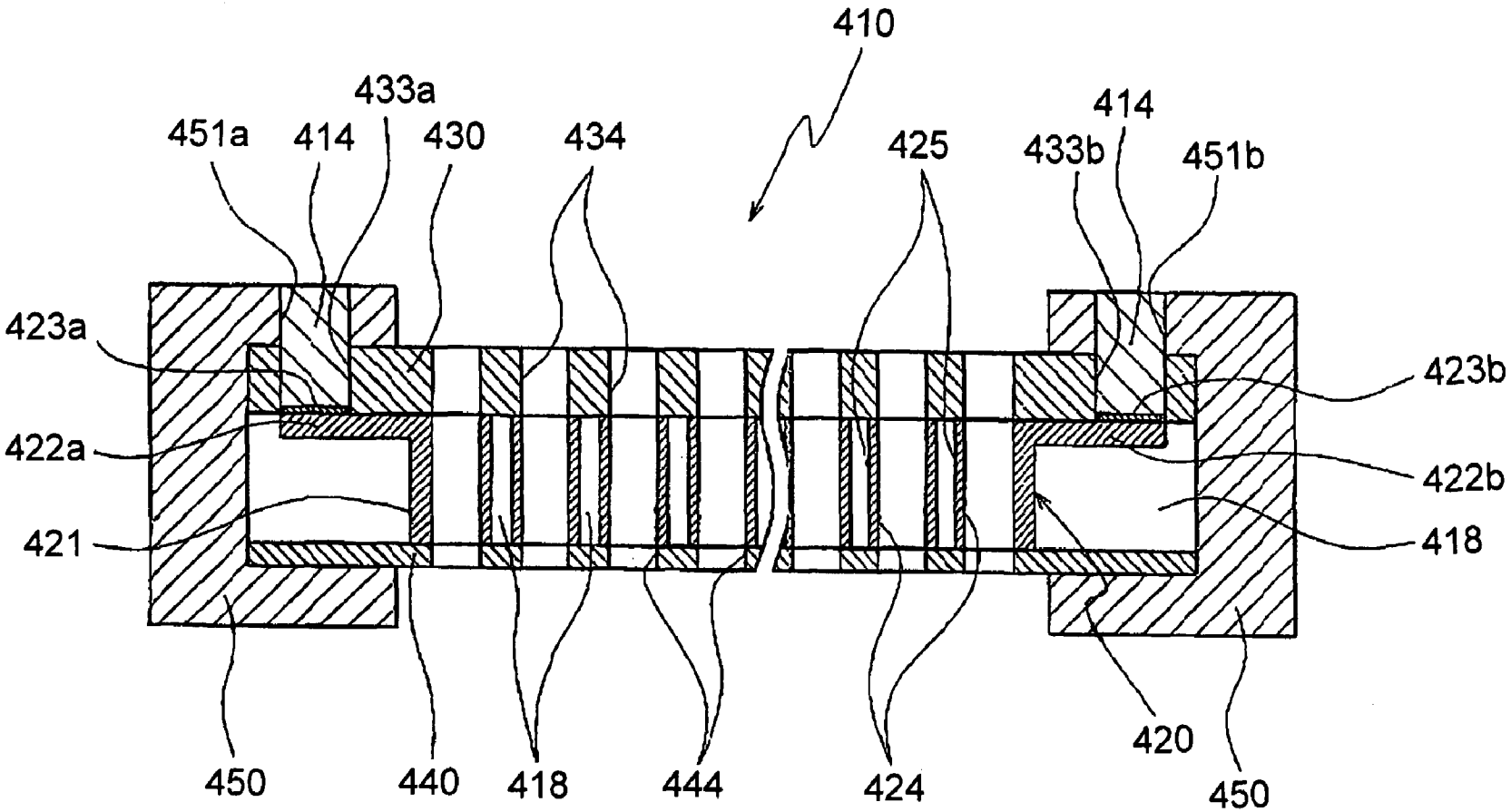
FIG. 13 is an enlarged cross sectional view of a micro nozzle of the fuel injector in accordance with the fourth embodiment of the present invention.

The needle valve 405 is driven by the drive unit 121, and the needle valve 405 opens and closes the flow rate regulating hole 404 when it moves in the up and down direction of FIG. 13. The electric power supply 122 serving as a power supply for heating the micro nozzle 410 and for driving the needle valve 405 is connected to the electrodes 406*a* and 406*b* and the drive unit 121 through the controller 120.

The controller 120 is configured to control whether or not electric power is supplied to the electrodes 406*a* and 406*b* (i.e., timing for supplying electric power to the electrodes 406*a* and 406*b*). Moreover, the controller 120 is configured to control whether the needle valve 405 is opened or closed and to control the amount of the movement of the needle valve 405 by controlling the drive unit 121.

Figure 14:
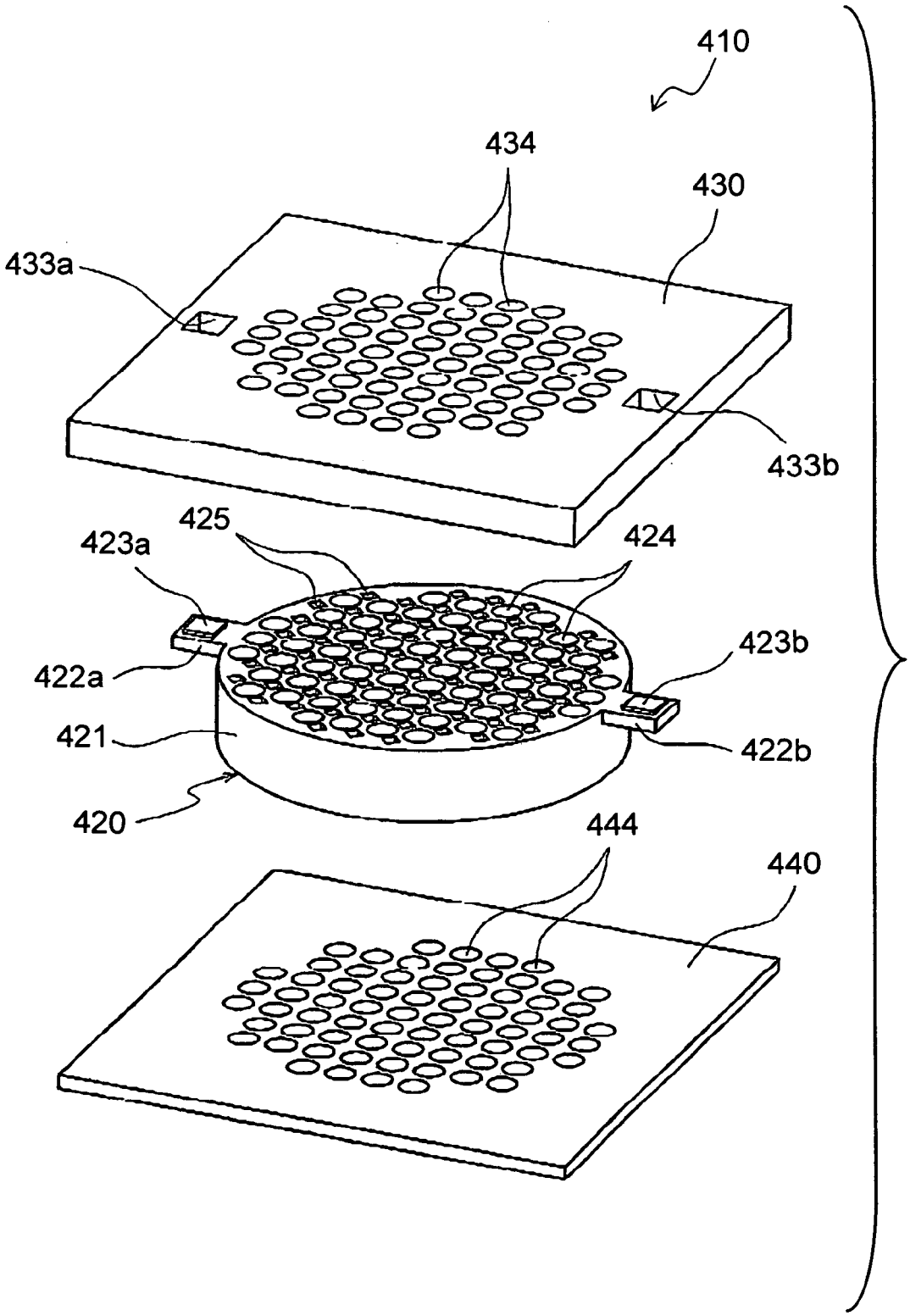
FIG. 14 is an exploded perspective view of the micro nozzle in accordance with the fourth embodiment of the present invention.
Figure 15:
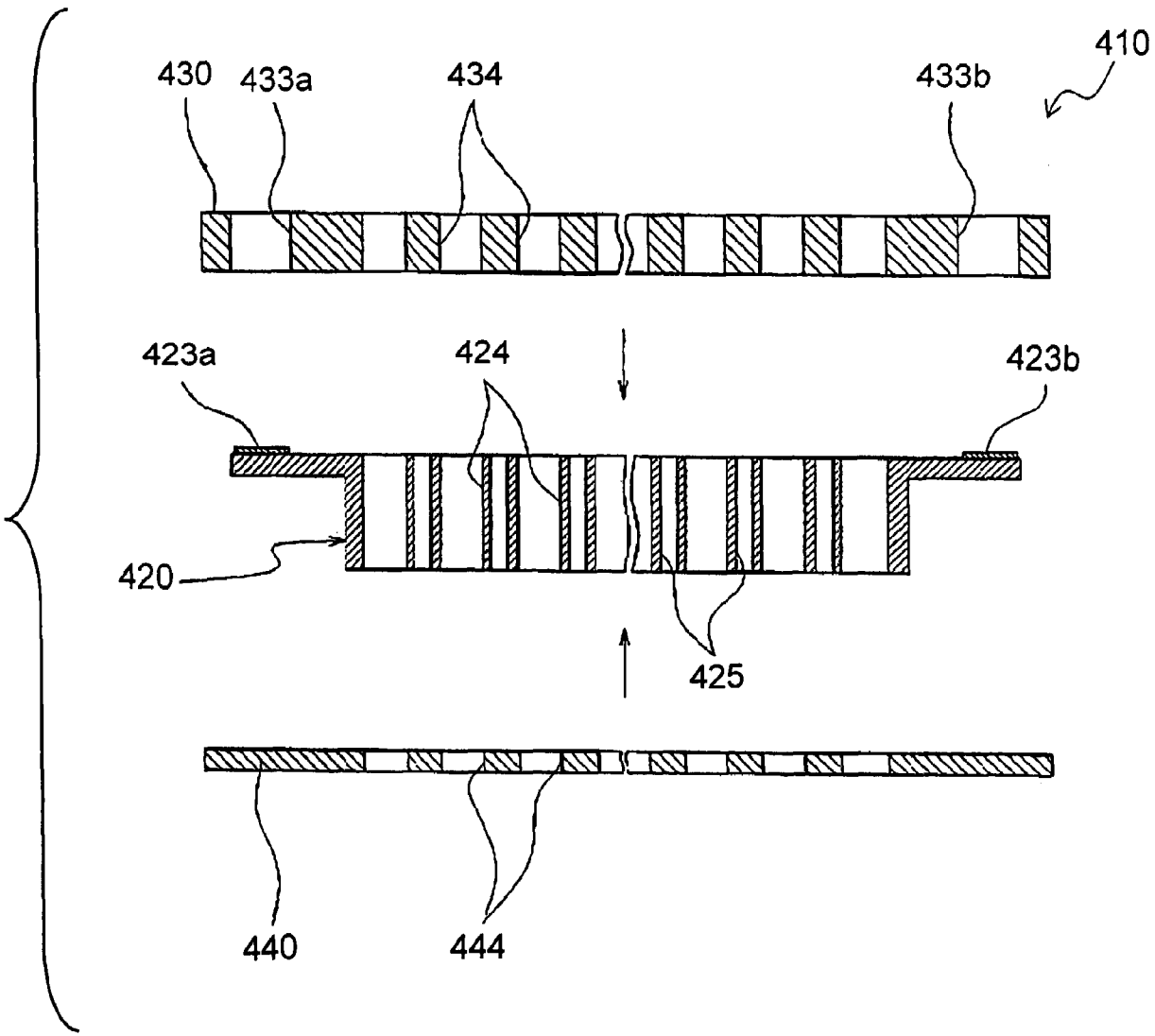
FIG. 15 is an exploded cross sectional view of the micro nozzle illustrating a method of manufacturing the micro nozzle in accordance with the fourth embodiment of the present invention.

Referring now to FIGS. 13 to 15, the micro nozzle 410 will be described in detail. FIG. 13 is an enlarged cross sectional view of the micro nozzle 410 of the fuel injector 400 in accordance with the fourth embodiment of the present invention. FIG. 14 is an exploded perspective view of the micro nozzle 410.

The micro nozzle 410 basically comprises a heating element 420 (electrically conductive member) for raising the temperature of the fuel, and an upper structural body 430 and a lower structural body 440 that are configured and arranged to cover the upper and lower surfaces of the heating element 420. The heating element 420 is made of an electrically conductive material (e.g., metal or silicon) having a large heat transfer coefficient. The upper structural body 430 and the lower structural body 440 are made of electrically insulating materials (e.g., a non-metal) having a small heat transfer coefficient. The heating element 420 and the upper structural body 430, and the heating element 420 and the lower structural body 440 are joined together.

The heating element 420 comprises a circular column-shaped heating part 421 and a pair of protruding parts 422*a* and 422*b* that extend outward from the outer perimeter of the heating part 421 as best seen in FIG. 14.

The heating part 421 is provided with a plurality of through holes 424 and a plurality of insulation holes 425 that connect between the surface of the heating element 420 where the lower structural body 440 is coupled to and the surface of the heating element 420 where the upper structural body 430 is coupled to. Each of the through holes 424 has a circular cross sectional shape and serve as holes for the fuel to pass through. Each of the insulation holes 425 preferably has a quadrilateral cross sectional shape and are filled with insulating entity 418 (described in detail later).

The upper structural body 430 includes a plurality of through holes 434 in positions that correspond to the through holes 424 of the heating element 420 when the upper structural body 430 is coupled to the heating element 420. Likewise, the lower structural body 440 includes a plurality of through holes 444 in positions that correspond to the through holes 424 of the heating element 420 when the lower structural body 440 is coupled to the heating element 420. Thus, the through holes 434 of the upper structural body 430 serve as flow passages for drawing the fuel into the heating element 420, and the through holes 444 of the lower structural body 440 serve as flow passages for supplying the fuel to the internal combustion engine after it has been heated by the heating element 420.

The positions on the lower structural body 440 and the upper structural body 430 that correspond to the insulation holes 425 of the heating element 420 are not open and the insulation holes 425 of the heating element 420 are sealed or closed by the lower structural body 440 and the upper structural body 430.

Two electrodes 423*a* and 423*b* are formed on the surfaces of the protruding parts 422*a* and 422*b* of the heating element 420 that face the upper structural body 430 as shown in FIGS. 13 and 14. The upper structural body 430 is provided with a pair of electrode holes 433*a* and 433*b* in positions that correspond to the electrodes 423*a* and 423*b* when the upper structural body 430 is coupled to the heating element 420.

As shown in FIG. 13, the upper structural body 430, the heating element 420, and the lower structural body 440 are coupled together and outer perimeter portions of the upper structural body 430 and the lower structural body 440 are surrounded by the thermal separation structural body 450, which is made of a material having a small heat transfer coefficient, e.g., a ceramic or quartz material. The thermal separation structural body 450 has a pair of electrode holes 451*a* and 451*b* arranged in such positions that they align with the electrode holes 433*a* and 433*b* of the upper structural body 430 when the micro nozzle 410 is fitted into the thermal separation structural body 450.

A lead electrode 414*a* is provided in the electrode hole 451*a* and the electrode hole 433*a*. One end of the lead electrode 414*a* is connected to the electrode 423*a* and the other end is drawn out from the thermal separation structural body 450 and connected to the electrode 406*a* as shown in FIG. 12. Similarly, a lead electrode 414*b* is provided in the electrode hole 451*b* and the electrode hole 433*b*. One end of the lead electrode 414*b* is connected to the electrode 423*b* and the other end is drawn out from the thermal separation structural body 450 and connected to the electrode 406*b* as shown in FIG. 12. Therefore, an electric current flows in the left and right direction (i.e., horizontal direction) of FIG. 13 when a voltage is applied to the lead electrodes 414*a* and 414*b*.

When the micro nozzle 410 is fitted into the thermal separation structural body 450, the thermally insulating entity 418 having a higher thermal resistance than the heating element 420 fills the space between the outer circumferential surface of the heating element 420 and the thermal separation structural body 450. As mentioned above, the thermally insulating entity 418 also fills the insides of the insulation holes 425 formed in the heating element 420.

Since the insulation holes 425 are filled with the thermally insulating entity 418, the insulation holes 425 become insulated regions and only the regions near the through holes 424 can be made to emit heat when an electric current is passed through the heating element 420.

When a voltage is applied to the electrodes 406*a* and 406*b*, the heating element 420 undergoes Joule heating. As a result, fuel that passes through the needle valve 405 and into the through holes 434 of the upper structural body 430 is heated rapidly as it flows through the through holes 424 of the heating element 420. The fuel then exits the through holes 444 of the lower structural body 440 and is injected toward the inside of the combustion chamber in a high temperature, high pressure state.

The controller 120 is configured to control the drive unit 121 and the voltage applied to the electrodes 406*a* and 406*b* such that the voltage is applied to the electrodes 406*a* and 406*b* and the heating element 420 is heated at a timing substantially corresponding to when the needle valve 405 opens. Thus, electric power is only supplied to the heating element 420 when fuel is flowing through the through holes 424 of the heating element 420. In FIG. 14, only the upper structural body 430, the heating element 420, and the lower structural body 440 of the micro nozzle 410 are illustrated for the sake of brevity.

Referring now to FIG. 15, a method of manufacturing the micro nozzle 410 will be explained.

FIG. 15 is a cross sectional view of the heating element 420, the upper structural body 430, and the lower structural body 440 illustrating an assembly procedure of the micro nozzle 410.

The through holes 434 and the through holes 444 are formed in the upper structural body 430 and the lower structural body 440, respectively, using a conventional hole forming method in advance. Examples of hole forming methods that can be used include drilling, electric discharge machining, etching, and punching.

The through holes 424 that will serve as fuel flow passages and the insulation holes 425 that will serve as thermal insulation regions are also formed in the heating element 420 in advance. If the heating element 420 is made of silicon, the through holes 424 and the insulation holes 425 can be formed using a conventional deep RIE.

The electrodes 423*a* and 423*b* are formed to exist only on the protruding parts 422*a* and 422*b* by vapor depositing metal electrodes made of W, Ni, Pt or the like and patterning the deposited metal on the surface of the heating element 420 that will be coupled to the upper structural body 430.

The electrode holes 433*a* and 433*b* are machined into the upper structural body 430 at positions that will correspond to the electrodes 423*a* and 423*b* when the upper structural body 430 is coupled to the heating element 420.

After the through holes 444 of the lower structural body 440, the through holes 434 and the electrode holes 433*a* and 433*b* of the upper structural body 430, the through holes 424 and the insulation holes 425 of the heating element 420 are formed, the through holes 434, 424 and 444 are aligned with each other to secure the fuel flow passages and the upper structural body 430, the heating element 420, and the lower structural body 440 are coupled together.

The upper structural body 430, the heating element 420, and the lower structural body 440 are preferably coupled together by diffusion welding or friction welding. In the case of diffusion welding, the welding is conducted in a vacuum state or an atmosphere of argon gas or $N_2$ gas and the temperature and pressure are raised as high as possible to increase the adhesion between the parts. Since the diffusion welding is conducted in the vacuum state, the insides of the insulation holes 425 of the heating element 420 are sealed in the vacuum state and thereby thermally insulated. Thus, in the fourth embodiment of the present invention, the vacuum state that exists inside the insulation holes 425 constitutes the thermally insulating entity 418.

After the micro nozzle 410 has been formed by coupling the upper structural body 430, the heating element 420, and the lower structural body 440 together, the thermal separation structural body 450 is arranged on the outer perimeter of the micro nozzle 410. Here, too, since the thermal separation structural body 450 is attached to the outer perimeter of the micro nozzle 410 under the vacuum state, the space between the heating part 421 and the thermal separation structural body 450 is in the thermally insulated vacuum state. In the fourth embodiment, the vacuum state that exists between the heating part 421 and the thermal separation structural body 450 constitutes the thermally insulating entity 418.

Also, in the fourth embodiment, the needle valve 405 constitutes the fuel discharge valve of the present invention, the heating element 420 constitutes the heating structure and the electrically conductive material of the present invention, the controller 120 constitutes the energy supply unit of the present invention, and the thermally insulating entity 418 constitutes the thermal insulating member of the present invention.

The micro nozzle 410 of the fourth embodiment being configured as described heretofore, the heat capacity of the heating element 420 is markedly reduced due to the thermally insulating entities 418 being arranged around the through holes 424 through which the fuel flows. As a result, the time required to heat the heating element 420 and to raise the temperature of the fuel passing through the through holes 424 can be greatly reduced.

Also, since the heating element 420 only exists in the vicinity of the through holes 424 through which the fuel flows and the through holes 424 are surrounded by the thermally insulating entity 418, the regions of the heating element 420 surrounding the through holes 424 are thermally insulated. As a result, thermal losses are small and the energy efficiency with which the temperature of the fuel passing through the through holes 424 is raised can be improved.

Since the controller 120 is configured to apply a voltage to the electrodes 406*a* and 406*b* at timing corresponding to when the needle valve 405 opens, electric power is supplied to the heating element 420 only when fuel is flowing through the through holes 424 and the energy efficiency with which the temperature of the fuel is raised can be improved.

Since the lower structural body 440 having a small heat transfer coefficient is coupled to the surface of the fuel injection side of the heating element 420, the heat capacity of the heating element 420 can be prevented from increasing due to adhered fuel in the event that some fuel injected from the micro nozzle 410 should splash back onto the surface of the fuel injection side of the micro nozzle 410. As a result, the fuel passing through the heating element 420 can be heated efficiently.

Although, in the fourth embodiment, the heating element 420 is configured (i.e., the lead electrodes 423*a* and 423*b* are arranged) such that the electric current flows horizontally therethrough from the perspective of FIG. 13, the invention is not limited to such an arrangement. It is also acceptable to arrange for the current to flow from the upper surface toward the lower surface as in the previous embodiments or from the lower surface toward the upper surface.

Although, in the fourth embodiment, the thermally insulating entity 418 is obtained by forming a vacuum state, the present invention is not limited to using a vacuum and it is also possible to use a material having a high thermal resistance as the thermally insulating entity 418.

Figure 16:
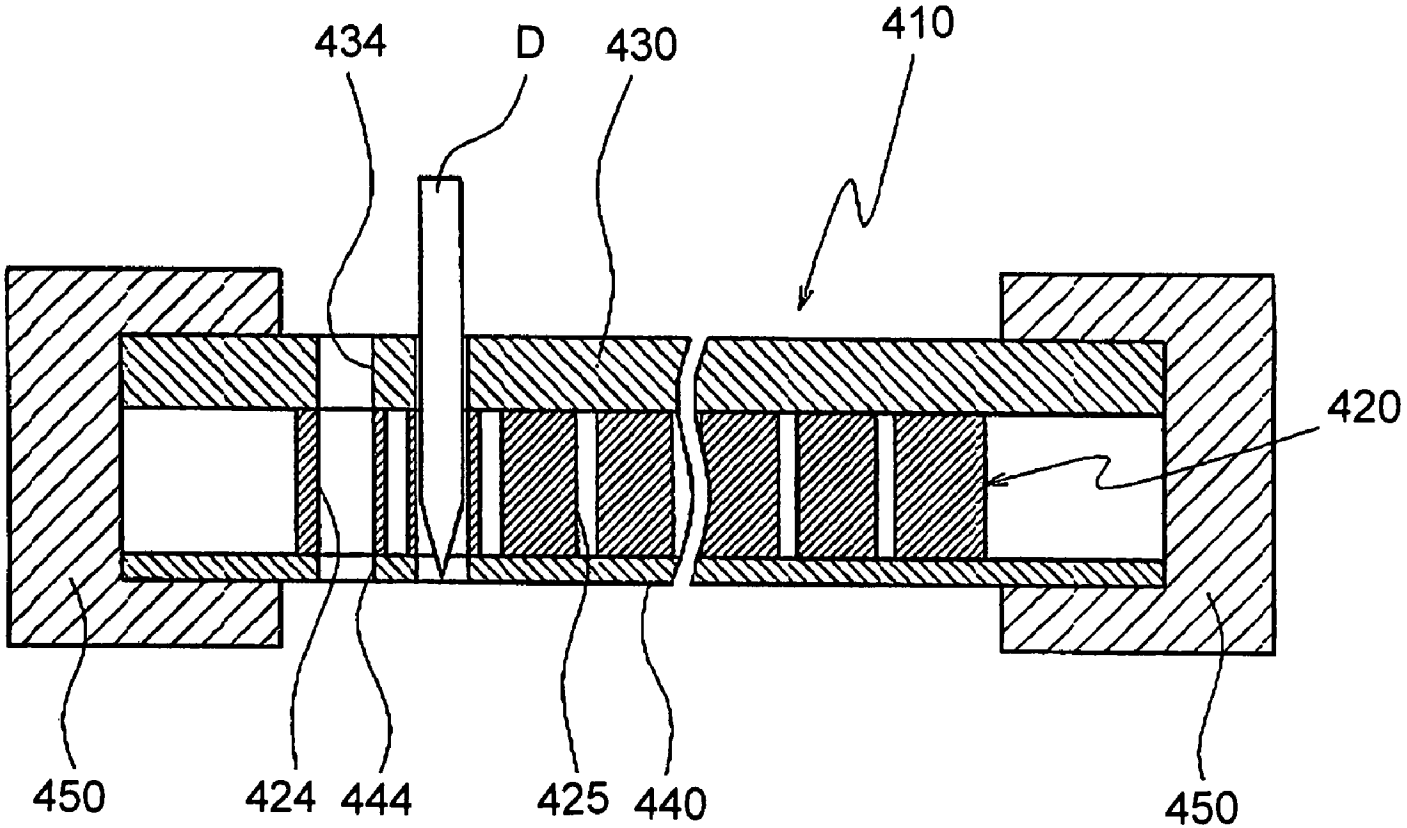
FIG. 16 is a cross sectional view of the micro nozzle illustrating an alternative method of manufacturing the micro nozzle in accordance with the fourth embodiment of the present invention.

Referring now to FIG. 16, an alternative method of manufacturing the micro nozzle 410 in accordance with the fourth embodiment will now be explained.

In this alternative method, only the insulation holes 425 are formed in the heating element 420 first. The upper structural body 430 in which only the electrode holes 433*a* and 433*b* are formed, the heating element 420 in which only the insulation holes 425 are formed, and the lower structural body 440 in which no holes are formed are coupled together by diffusion welding. The diffusion welding is conducted under a vacuum so that the thermally insulating entities 418 (vacuum state) fill the insides of the insulation holes 425.

Next, a drill D is used to form the through holes 434, 424 and 444 in an integral structural body comprising the upper structural body 430, the heating element 420, and the lower structural body 440. The method of forming the holes is not limited to machining using the drill D. For example, methods such as electric discharging machining, etching, and punching can also be used to form the through holes 434, 424 and 444 in an integral structural body comprising the upper structural body 430, the heating element 420, and the lower structural body 440.

By forming the through holes 434, 424, and 444 simultaneously in the upper structural body 430, the heating element 420, and the lower structural body 440, respectively, that are integrally joined together, mispositioning of the through holes 434, 424, and 444 with respect to one another is prevented. Thus, flow passages for fuel to pass through can be formed easily.

Fifth Embodiment

Figure 17:
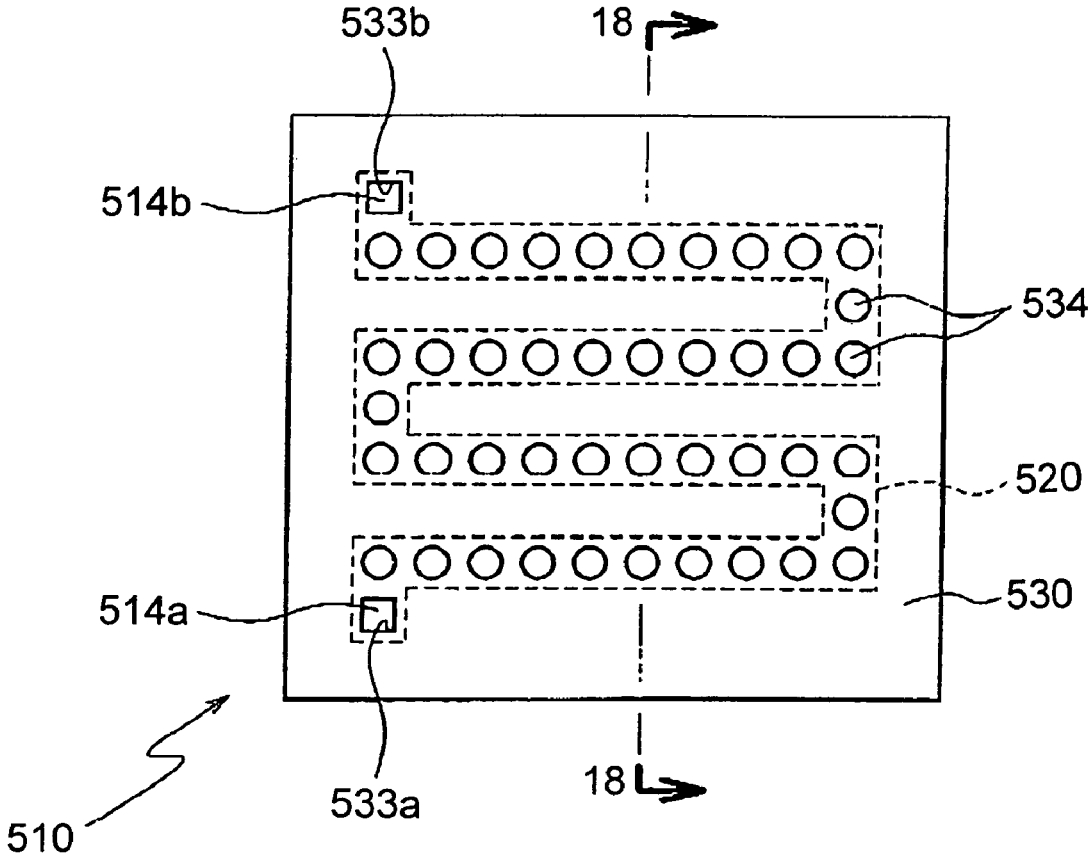
FIG. 17 is a simplified top plan view of a micro nozzle of a fuel injector in accordance with a fifth embodiment of the present invention.
Figure 18:
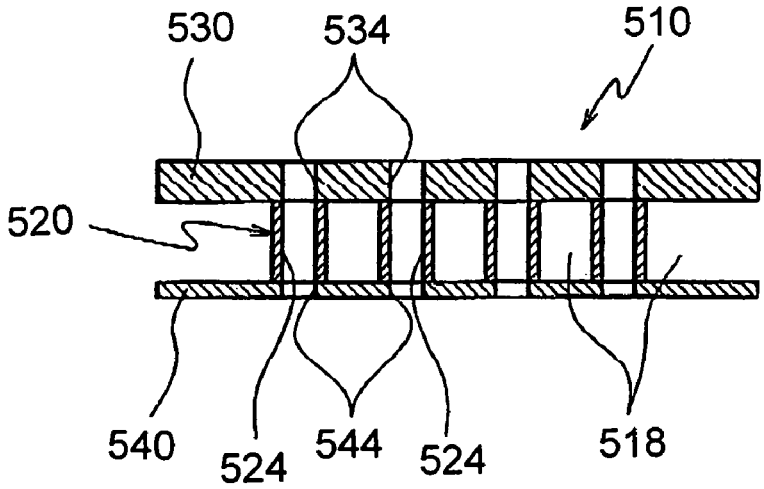
FIG. 18 is a cross sectional view of the micro nozzle taken along a section line 18-18 of FIG. 17 in accordance with the fifth embodiment of the present invention.
Figure 19:
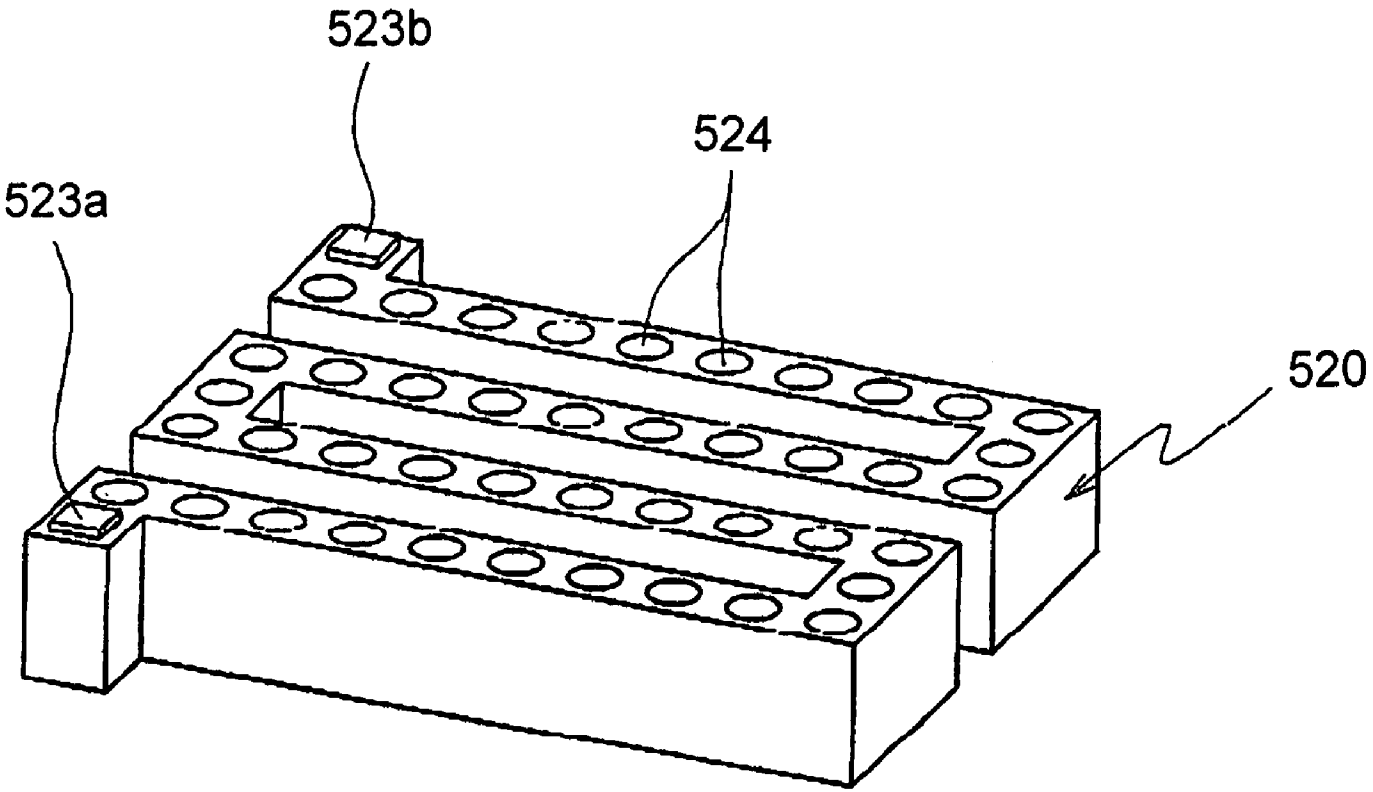
FIG. 19 is a perspective view of a heating element of the micro nozzle illustrated in FIGS. 17 and 18 in accordance with the fifth embodiment of the present invention.

Referring now to FIGS. 17 to 19, a fuel injector in accordance with a fifth embodiment will now be explained. In view of the similarity between the fourth and fifth embodiments, the parts of the fifth embodiment that are identical to the parts of the fourth embodiment will be given the same reference numerals as the parts of the fourth embodiment. Moreover, the descriptions of the parts of the fifth embodiment that are identical to the parts of the fourth embodiment may be omitted for the sake of brevity.

FIG. 17 is a simplified top plan view of a micro nozzle 510 in accordance with the fifth embodiment of the present invention. FIG. 18 is a cross sectional view of the micro nozzle 510 taken along a section line 18-18 of FIG. 17. FIG. 19 is a perspective view of a heating element 520 (electrically conductive member) of the micro nozzle 510 illustrated in FIGS. 17 and 18.

In the fifth embodiment of the present invention, the micro nozzle 510 is used in the fuel injector 400 shown in FIG. 12 in place of the micro nozzle 410. In other words, a position in which the micro nozzle 510 is mounted to the fuel injector 400 is the same as the position in which the micro nozzle 410 is mounted to the fuel injector 400 in the fourth embodiment illustrated in FIG. 12. Thus, a detail description of the structure of the fuel injector 400 is omitted for the sake of brevity.

In the fifth embodiment, the heating element 520 of the micro nozzle 510 comprises a belt-shaped member that is provided with a plurality of slit-shaped through holes 524 and bent into a generally wave-shaped or zigzag-shaped as seen in FIGS. 17 and 19.

An upper structural body 530 having a plurality of through holes 534 and a lower structural body 540 having a plurality of through holes 544 are coupled to the heating element 520 in such a manner as to sandwich the heating element 520 therebetween.

The upper structural body 530 and the lower structural body 540 are coupled to the heating element 520 such that the through holes 534 provided in the upper structural body 530, the through holes 524 provided in the heating element 520, and the through holes 544 provided in the lower structural body 540 are aligned so as to communicate with one another to form fuel flow passages. The through holes 534, 524 and 544 can be formed using the same method used for forming the through holes 434, 424 and 444 as described in the fourth embodiment.

As shown in FIG. 19, two lead electrodes 523*a* and 523*b* are patterned onto the end parts of the heating element 520 on the surface thereof that is coupled to the upper structural body 530.

The upper structural body 530 is provided with a pair of electrode holes 533*a* and 533*b* in positions that correspond to electrodes 523*a* and 523*b* when the upper structural body 530 is coupled to the heating element 520.

Two lead electrodes 514*a* and 514*b* are arranged in the electrode holes 533*a* and 533*b* in a manner similar to the lead electrodes 414*a* and 414*b* are arranged in the electrode holes 433*a* and 433*b* in the fourth embodiment. The inserted ends of the lead electrodes 514*a* and 514*b* are connected to the electrodes 523*a* and 523*b*, respectively, and the other ends of the lead electrodes 51*a* and 514*b* are connected to the electrodes 406*a* and 406*b* (FIG. 12) for supplying electric power from the power supply 122 to the heating element 520.

Similarly to the fourth embodiment, the thermal separation structural body 450 (FIG. 12) surrounds the outer perimeter of the micro nozzle 510. As a result, the space enclosed by the upper structural body 530, the lower structural body 540, and the thermal separation structural body is sealed closed and forms a thermally insulating entity 518, similarly to the thermally insulating entity 418 of the fourth embodiment.

An electric current flows inside the heating element 520 from the electrode 523*a* toward the electrode 523*b* or from the electrode 523*b* toward the electrode 523*a* when a voltage is applied to the electrodes 523*a* and 523*b* through the lead electrodes 514*a* and 514*b*, respectively. Thus, electric current can be supplied in a uniform fashion to all of the through holes 524 formed in the heating element 520 and a uniform temperature distribution can be achieved in the heating element 520.

Although in the fifth embodiment, the belt-shaped heating element 520 is bent into wave-shaped, other configurations are also possible for the heating element 520. For example, a belt-shaped heating element member can be formed into a spiral shape or any of various other shapes.

Although, in the first to fifth embodiments explained above, the electric power is supplied to the micro nozzle 110, 210, 310, 410 or 510 at a timing corresponding to when the needle valve 105 or 405 opens, it is also acceptable to configure the fuel injector in accordance with the present invention such that the micro nozzle is electrically energized in synchronization with the opening and closing of the needle valve.

As used herein, the following directional terms "forward, rearward, above, downward, vertical, horizontal, below and transverse" as well as any other similar directional terms refer to those directions of a device equipped with the present invention. Accordingly, these terms, as utilized to describe the present invention should be interpreted relative to a device equipped with the present invention. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fuel injector configured and arranged to inject fuel into a combustion chamber of an engine comprising:

a casing member including a hydraulic chamber configured to contain pressurized fuel at a prescribed pressure and a flow rate regulating hole arranged to discharge the fuel from inside the hydraulic chamber;

a fuel discharge valve configured and arranged to open and close the flow rate regulating hole of the casing member;

a micro nozzle disposed in a downstream part with respect to the fuel discharge valve, the micro nozzle having at least one through hole arranged to inject the fuel discharged from the flow rate regulating hole into the combustion chamber, the micro nozzle further including a heating structure configured and arranged to selectively emit heat to raise temperature of the fuel that passes through the at least one through hole of the micro nozzle upon activation of the heating structure; and an energy supply unit operatively coupled to the micro nozzle to selectively supply energy to the micro nozzle, the energy supply unit being further operatively coupled to a drive unit of the fuel discharge valve such that the energy is supplied to the micro nozzle at a timing substantially corresponding to when the fuel passes through the at least one through hole.

2. A fuel injector configured and arranged to inject fuel into a combustion chamber of an engine comprising:

a casing member including a hydraulic chamber configured to contain pressurized fuel at a prescribed pressure and a flow rate regulating hole arranged to discharge the fuel from inside the hydraulic chamber;

a fuel discharge valve configured and arranged to open and close the flow rate regulating hole of the casing member;

a micro nozzle disposed in a downstream part with respect to the fuel discharge valve, the micro nozzle having at least one through hole arranged to inject the fuel discharged from the flow rate regulating hole into the combustion chamber, the micro nozzle further including a heating structure configured and arranged to selectively emit heat to raise temperature of the fuel that passes through the at least one through hole of the micro nozzle upon activation of the heating structure; and an energy supply unit operatively coupled to the micro nozzle to selectively supply electric power to the micro nozzle so that the heating structure of the micro nozzle emits heat when supplied with the electric power.

3. The fuel injector as recited in claim 2, wherein the heating structure of the micro nozzle is configured and arranged such that an electric current flows between a first main surface and a second main surface of the micro nozzle.

4. The fuel injector as recited in claim 3, wherein the heating structure of the micro nozzle comprises an electrically conductive substrate having first and second main surfaces with the through hole extending therebetween, and the micro nozzle further includes first and second lead electrodes coupled to the first and second main surfaces of the electrically conductive substrate, respectively, the first and second lead electrodes being coupled to the energy supply unit so that electric current flows in the electrically conductive substrate to raise the temperature of the fuel that passes through the at least one through hole when the electric power is supplied to the first and second lead electrodes.

5. The fuel injector as recited in claim 4, wherein the micro nozzle further includes one impurity layer disposed between the first main surface of the electrically conductive substrate and the first lead electrode, and another impurity layer disposed between the second main surface of the electrically conductive substrate and the second lead electrode.

6. The fuel injector as recited in claim 4, wherein the electrically conductive substrate is made of a semiconductor material.

7. The fuel injector as recited in claim 3, wherein the micro nozzle further includes an electrically insulating substrate having first and second main surfaces with the at least one through hole extending therebetween, an electrically conductive thin film forming the heating structure, the electrically conductive thin film covering the first and second main surfaces of the electrically insulating substrate and an internal surface of the at least one through hole, and first and second lead electrodes disposed on a perimeter of the electrically insulating substrate, the first and second lead electrodes being coupled to the electrically conductive thin film so that the electric current flows in the electrical conductive thin film to raise the temperature of the fuel that passes through the at least one through hole when the electric power is supplied to the first and second lead electrodes from the energy supply unit.

8. The fuel injector as recited in claim 2, wherein the micro nozzle includes a protective film formed on a portion of the micro nozzle that is configured and arranged to contact the fuel.

9. A fuel injector configured and arranged to inject fuel into a combustion chamber of an engine comprising:

a casing member including a hydraulic chamber configured to contain pressurized fuel at a prescribed pressure and a flow rate regulating hole arranged to discharge the fuel from inside the hydraulic chamber;

a fuel discharge valve configured and arranged to open and close the flow rate regulating hole of the casing member;

a micro nozzle disposed in a downstream part with respect to the fuel discharge valve, the micro nozzle having at least one through hole arranged to inject the fuel discharged from the flow rate regulating hole into the combustion chamber, the micro nozzle including a heating structure configured and arranged to selectively emit heat to raise temperature of the fuel that passes through the at least one through hole of the micro nozzle upon activation of the heating structure, the heating structure configured and arranged such that an electric current flows between a first main surface and a second main surface of the micro nozzle, the heating structure comprising an electrically conductive substrate having first and second main surfaces, the electrically conductive substrate including a through hole forming section in which the at least one through hole is formed and a substrate perimeter section that is arranged around an outside perimeter of the through hole forming section, a thermal insulation member arranged around a perimeter portion of the at least one through hole in the through hole forming section of the electrically conductive substrate, a first impurity layer disposed on one of the first and second main surfaces of the electrically conductive substrate in the substrate perimeter section thereof, a pair of second impurity layers disposed on the first and second main surfaces of the electrically conducting substrate, respectively, in the through hole forming section and the substrate perimeter section over the first impurity layer formed on the one of the first and second main surfaces of the electrically conducting substrate in the substrate perimeter section, the second impurity layers having an opposite conductivity type from the first impurity layer, and first and second lead electrodes provided on the second impurity layers on the first and second main surfaces of the electrically conducting substrate in the substrate perimeter section so that electric current flows from the second impurity layer to the electrically conductive substrate in the through hole forming section to raise the temperature of the fuel that passes through the at least one through hole when electric power is applied to the first and second lead electrodes; and an energy supply unit operatively coupled to the micro nozzle to selectively supply the electric power to the first and second lead electrodes of the micro nozzle so that the heating structure of the micro nozzle emits heat when supplied with the electric power.

10. The fuel injector as recited in claim 9, wherein the at least one through hole includes a plurality of through holes, and the second impurity layers includes a plurality of through hole peripheral portions disposed around the through holes on the first and second main surfaces of the electrically conductive substrate in the through hole forming section and a plurality of connecting portions that connect adjacent ones of the through hole peripheral portions together.

11. The fuel injector as recited in claim 10, wherein the thermal insulation member is disposed between adjacent ones of the through holes.

12. The fuel injector as recited in claim 9, wherein the electrically conductive substrate is made of a semiconductor material.

13. A fuel injector configured and arranged to inject fuel into a combustion chamber of an engine comprising:

a casing member including a hydraulic chamber configured to contain pressurized fuel at a prescribed pressure and a flow rate regulating hole arranged to discharge the fuel from inside the hydraulic chamber;

a fuel discharge valve configured and arranged to open and close the flow rate regulating hole of the casing member; and a micro nozzle disposed in a downstream part with respect to the fuel discharge valve, the micro nozzle having at least one through hole arranged to inject the fuel discharged from the flow rate regulating hole into the combustion chamber, the micro nozzle further including a heating structure configured and arranged to selectively emit heat to raise temperature of the fuel that passes through the at least one through hole of the micro nozzle upon activation of the heating structure, the heating structure of the micro nozzle including an electrically conductive member with the through hole provided therein, and a thermal insulating entity arranged around a perimeter portion of the at least one through hole in the electrically conductive member.

14. The fuel injector as recited in claim 13, wherein the thermal insulting entity includes an area containing air or vacuum.

15. The fuel injector as recited in claim 13, wherein the electrically conductive member is made of metal.

* * * * *